US009359167B2

(12) United States Patent
Musha et al.

(10) Patent No.: US 9,359,167 B2
(45) Date of Patent: Jun. 7, 2016

(54) SHEET PROCESSING DEVICE, IMAGE FORMING SYSTEM, AND METHOD OF ADDITIONALLY FOLDING SHEET BUNDLE

(71) Applicants: Akihiro Musha, Kanagawa (JP); Keisuke Sugiyama, Kanagawa (JP); Kiyoshi Hata, Tokyo (JP); Takeshi Akai, Kanagawa (JP); Ikuhisa Okamoto, Kanagawa (JP); Jun Yamada, Kanagawa (JP); Takao Watanabe, Kanagawa (JP)

(72) Inventors: Akihiro Musha, Kanagawa (JP); Keisuke Sugiyama, Kanagawa (JP); Kiyoshi Hata, Tokyo (JP); Takeshi Akai, Kanagawa (JP); Ikuhisa Okamoto, Kanagawa (JP); Jun Yamada, Kanagawa (JP); Takao Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 16 days.

(21) Appl. No.: 14/468,868

(22) Filed: Aug. 26, 2014

(65) Prior Publication Data

US 2015/0065326 A1 Mar. 5, 2015

(30) Foreign Application Priority Data

Aug. 29, 2013 (JP) ..... 2013-178480

(51) Int. Cl.

| | |
|---|---|
| ***B65H 45/04*** | (2006.01) |
| ***B65H 45/12*** | (2006.01) |
| *B65H 45/18* | (2006.01) |

(52) U.S. Cl.

CPC ..... *B65H 45/04* (2013.01); *B65H 45/12* (2013.01); *B65H 45/18* (2013.01); *B65H 2301/5123* (2013.01); *B65H 2701/13212* (2013.01); *B65H 2801/27* (2013.01)

(58) Field of Classification Search

CPC ..... B65H 45/12; B31F 1/003; B31F 1/0035
USPC ..... 270/32, 45, 58.07; 493/407; 412/22
See application file for complete search history.

(56) References Cited

U.S. PATENT DOCUMENTS 5,520,604 A * 5/1996 Reist ..... 493/422
8,500,111 B2 * 8/2013 Terao ..... 270/45

(Continued)

FOREIGN PATENT DOCUMENTS

JP 2012-153530 8/2012
NL EP 2634125 A1 * 9/2013

OTHER PUBLICATIONS

U.S. Appl. No. 14/449,621, filed Aug. 1, 2014, Sugiyama, et al.
U.S. Appl. No. 14/449,621, filed Aug. 1, 2014.

(Continued)

*Primary Examiner* — Leslie A Nicholson, III
(74) *Attorney, Agent, or Firm* — Oblon, McClelland, Maier & Neustadt, L.L.P

(57) ABSTRACT

A sheet processing device comprising: a pressing unit that presses a fold line part of a folded sheet bundle; and a moving unit that moves a pressing position of the pressing unit in a fold direction of the folded sheet bundle, wherein the pressing unit includes a pair of pressing rollers that holds the folded sheet bundle therebetween, and the pair of pressing rollers changes an angle θ between a thickness direction of the folded sheet bundle and a line connecting the rotational centers of the pressing rollers in the middle of movement.

13 Claims, 30 Drawing Sheets

(56) References Cited

U.S. PATENT DOCUMENTS

| | | | |
|---|---|---|---|
| 2012/0190526 | A1 | 7/2012 | Terao |
| 2014/0187407 | A1 | 7/2014 | Kikuchi et al. |
| 2014/0203486 | A1 | 7/2014 | Sugiyama et al. |
| 2014/0203488 | A1 | 7/2014 | Hidaka et al. |
| 2014/0206516 | A1 | 7/2014 | Hata et al. |
| 2014/0206518 | A1 | 7/2014 | Hidaka et al. |
| 2014/0206519 | A1 | 7/2014 | Hoshino et al. |
| 2014/0213425 | A1 | 7/2014 | Sugiyama et al. |

OTHER PUBLICATIONS

Alex Kaplan et. al. "Finite element simulation of a perturbed axial-symmetric whispering-gallery mode . . . ," Optics Express V. 21 pp. 14169-14180; Jun. 27, 2013.

Wonmi Ahn et. al. "PhotonicPlasmonic Mode Coupling in On-Chip Integrated Optoplasmonic Molecules," ACS Nano V. 6, pp. 951-960; Dec. 8, 2011.

Wonmi Ahn et. al, "Demonstration of Efficient On-Chip Optoplasmonic Networks," ACS Nano V. 7, pp. 4470-4478; Apr. 19, 2013.

E. Gavartin et. al "A hybrid on-chip optomechanical transducer for ultrasensitive force measurements," Nature Nanotechnology V. 7, pp. 509-514; Jun. 24, 2014.

Dries Van Thourhout et. al. "Optomechanical device actuation through the optical gradient force," Nature Photonics V. 4, pp. 211-217; Mar. 31, 2010.

Xiaodong Yang et. al. "Optical Forces in Hybrid Plasmonic Waveguides," Nano Letters V. 11, pp. 321-328; Jan. 13, 2011.

J. F. Tao et. al. "On-chip optical power measurement by optical force," Transducers' 11 IEEE, pp. 1911-1914; Possibly Jun. 9, 2011, unknown exact date.

Matthew S. Luchansky et. al. "High-Q Optical Sensors for Chemical and Biological Analysis," Anal. Chem V. 84 pp. 793-821; Nov. 23, 2011.

G. Anetsberger et. al. "Near-field cavity optomechanics with nanomechanical oscillators," Nature Physics V. 5 pp. 909-914, Oct. 11, 2009.

A. Schliesser et. al. "High-sensitivity monitoring of micromechanical vibration using optical whispering gallery mode" arXiv:0-805. 1608c1 [quant-ph], pp. 1-25, May 12, 2008.

Onur Basarir et. al, "Sensitive meicromechanical displacement detection . . . " Optics Letters V. 35 No. 11, pp. 1792-1794; Jun. 1, 2010.

Min Ren et. al, "Nano-optomechanical Actuator . . . " ACS Nano V. 7 No. 2, pp. 1676-1681; Jan. 25, 2013.

G. C. Righini et. al. "Whispering gallery mode microresonators . . . " Rivista del nuovo cimento V. 34 No. 7, pp. 435-488; ricevuto il Mar. 30, 2011.

V. R. Dantham et. al, "Taking whispering gallery-mode . . . to the limit," Applied Physics Letters V. 101, pp. 043704-1 to 043704-4. Jul. 27, 2012.

Martin Baaske et. al. "Optical Resonator Biosensors . . . " ChemPysChem V. 13, pp. 427-436, likely published in 2012.

Maysamreza Chamanzar et. al. "Hybrid nanoplasmonic-photonic resonators . . . " Optics Express V. 19, No. 22, pp. 22292-22304; Oct. 24, 2011.

Victor Fiore, Chunhua Dong, Mark. C. Kuzyk, Hailin Wang. "Optomechanical light storage in a silica microresonator" the internet, unknown date. Dept. of physics, U. of Oregon.

Fangren et. al., "Second Harmonic Generation . . . resonator," Proc. of SPIE v. 8463, 846305, Oct. 15, 2012.

* cited by examiner (a)

(b)

(c)

(d)

SHEET PROCESSING DEVICE, IMAGE FORMING SYSTEM, AND METHOD OF ADDITIONALLY FOLDING SHEET BUNDLE

CROSS-REFERENCE TO RELATED APPLICATIONS

The present application claims priority to and incorporates by reference the entire contents of Japanese Patent Application No. 2013-178480 filed in Japan on Aug. 29, 2013.

BACKGROUND OF THE INVENTION

1. Field of the Invention

The present invention relates to a sheet processing device, an image forming system, and a method of additionally folding a sheet bundle, and specifically relates to a sheet processing device having a function for folding a sheet recording medium such as paper, recording paper, and transfer paper (hereinafter, simply referred to as a "sheet" in this specification), an image forming system including the sheet processing device, and a method of additionally folding a sheet bundle performed by the sheet processing device.

2. Description of the Related Art

In the related art, provided are postprocessing devices used in combination with image forming apparatuses such as a copying machine for binding a saddle-stitched booklet by folding one sheet, or by stitching the center part in the longitudinal direction of a sheet bundle including a plurality of sheets and folding the center part of the sheet bundle with a pair of folding rollers arranged in parallel to a sheet folding direction. An additional-folding technique is already known for reinforcing a fold line part of a saddle-stitched booklet after folding processing by an additional-folding roller moving along the fold line part after saddle-stitching and center-folding are performed.

As an example of such an additional-folding technique, known is a technique disclosed in Japanese Laid-open Patent Publication No. 2012-153530.

The technique provides a folding roller unit that forms a fold line on a sheet while passing through a nip of a pair of rollers, and an additional-folding roller unit including a first roller arranged on a first surface side orthogonal to a carrying direction of the sheet bundle folded by the folding roller unit and second and third rollers that are arranged on a second surface side different from the first surface orthogonal to the carrying direction of the folded sheet bundle and form a nip with the first roller. The technique also provides a driving unit that moves the additional-folding roller unit along the fold line part in a state in which the folded sheet bundle is held in the nip between the first roller and the second roller and the nip between the first roller and the third roller.

The additional-folding roller unit disclosed in Japanese Laid-open Patent Publication No. 2012-153530 includes, specifically, three additional-folding rollers to be driven along the fold line while holding the fold line part of the sheet bundle. In this case, a diameter of the first roller is larger than each of diameters of the second roller and the third roller. When three folding rollers are used as described above, two nips are formed, and tangential directions of the nips are not parallel to each other. Due to this, each of a line connecting the center of the large-diameter first roller and the center of the second roller and a line connecting the center of the large-diameter first roller and the center of the third roller is shifted from a thickness direction of sheets. The fold line part is reinforced due to the shift.

In this case, it is considered that good additional-folding strength can be obtained by changing an angle of the shift corresponding to the thickness of the sheet bundle or presence or absence of a staple. However, in the technique disclosed in Japanese Laid-open Patent Publication No. 2012-153530, additional-folding is basically performed at substantially a constant angle although an angle of the tangential direction of the nip is changed in some degree depending on the sheet thickness. This has caused deformation of the staple or drooping of an end of the sheet bundle. The deformation of the staple or the drooping has impaired stacking property of the sheet bundle.

In view of the above-mentioned conventional problems, there is a need to prevent the deformation of the staple or the drooping of the end of the sheet bundle in additional-folding, and prevent the stacking property of the sheet bundle from being impaired.

SUMMARY OF THE INVENTION

It is an object of the present invention to at least partially solve the problems in the conventional technology.

According to the present invention, there is provided a sheet processing device comprising: a pressing unit that presses a fold line part of a folded sheet bundle; and a moving unit that moves a pressing position of the pressing unit in a fold direction of the folded sheet bundle, wherein the pressing unit includes a pair of pressing rollers that holds the folded sheet bundle therebetween, and the pair of pressing rollers changes an angle θ between a thickness direction of the folded sheet bundle and a line connecting the centers of the pressing rollers in the middle of movement.

The present invention also provides an image forming system comprising the above-mentioned sheet processing device.

The present invention also provides a method of additionally folding a sheet bundle in a sheet processing device including a pressing unit that presses a fold line part of a folded sheet bundle, and a moving unit that moves a pressing position of the pressing unit in a fold direction of the sheet bundle, the method comprising: additionally folding a fold line part of the folded sheet bundle with the pressing unit including a pair of pressing rollers that holds the folded sheet bundle therebetween, and changing an angle θ between a thickness direction of the folded sheet bundle and a line connecting the centers of the pair of pressing rollers in the additional-folding.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to the present invention, an angle θ between a line connecting the centers of a pair of additional-folding rollers and a thickness direction of a sheet bundle is changed during an additional-folding operation. The following describes an embodiment of the present invention with reference to drawings.

Figure 1:
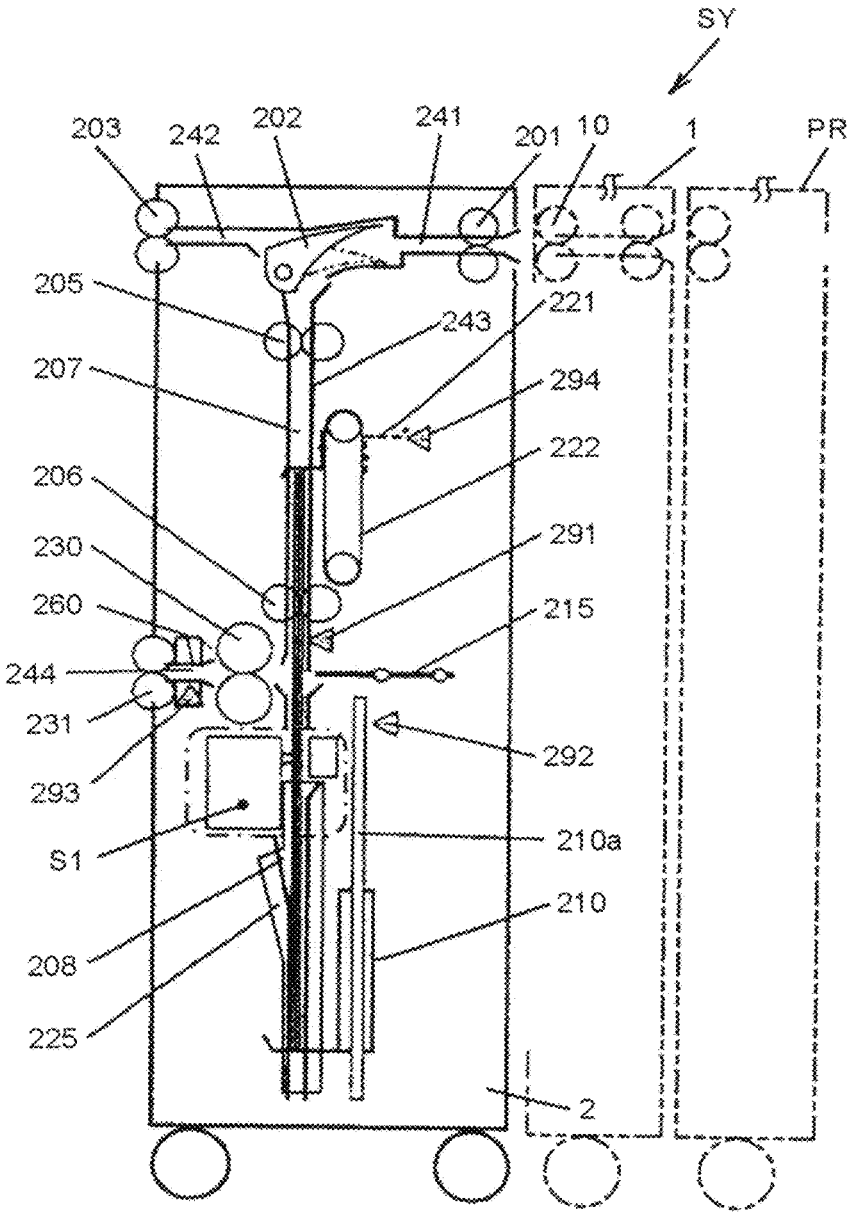
FIG. 1 is a diagram illustrating a system configuration of an image processing system including an image forming apparatus and a plurality of sheet processing devices according to an embodiment of the present invention.

FIG. 1 is a diagram illustrating a system configuration of an image processing system SY including an image forming apparatus PR and a plurality of sheet processing devices 1 and 2 according to the embodiment. In the embodiment, first and second sheet postprocessing devices 1 and 2 are coupled to a rear stage of an image forming apparatus PR in this order.

The first sheet postprccessing device 1 is a sheet postprocessing device having a function of preparing a sheet bundle for receiving sheets one by one from the image forming apparatus PR, overlapping and adjusting the sheets successively, and preparing the sheet bundle at a stack part. The first sheet postprocessing device 1 discharges the sheet bundle from a sheet bundle discharge roller 10 to the second sheet postprocessing device 2 at the rear stage. The second sheet postprocessing device 2 is a saddle-stitch bookbinding device that receives the carried sheet bundle and performs saddle-stitching and center-folding (herein, the second sheet postprocessing device is also referred to as a saddle-stitch bookbinding device).

The saddle-stitch bookbinding device 2 discharges the bound booklet (sheet bundle) as it is, or discharges it to a sheet processing device at the rear stage. The image forming apparatus PR forms a visible image on a sheet recording medium based on input image data or image data of a read image. Examples of the image forming apparatus PR include a copying machine, a printer, a facsimile, or a digital multifunction peripheral having at least two functions thereof. The image forming apparatus PR may employ a known method such as an electrophotographic method and a droplet injection method. Any image forming method may be employed.

As illustrated in FIG. 1, the saddle-stitch bookbinding device 2 includes an inlet carrying path 241, a sheet-through carrying path 242, and a center-folding carrying path 243. An inlet roller 201 is arranged on the most upstream part in a sheet carrying direction of the inlet carrying path 241, and the aligned sheet bundle is carried in the device from the sheet bundle discharge roller 10 of the first sheet postprocessing device 1. In the following description, an upstream side in the sheet carrying direction is simply referred to as an upstream side, and a downstream side in the sheet carrying direction is simply referred to as a downstream side.

A bifurcating claw 202 is arranged on the downstream side of the inlet roller 201 of the inlet carrying path 241. The bifurcating claw 202 is arranged in the horizontal direction of the figure, and bifurcates the carrying direction of the sheet bundle into the sheet-through carrying path 242 or the center-folding carrying path 243. The sheet-through carrying path 242 is a carrying path that horizontally extends from the inlet carrying path 241 and guides the sheet bundle to a processing device (not illustrated) on the rear stage or a paper discharge tray.

The sheet bundle is discharged to the rear stage by an upper paper discharge roller 203. The center-folding carrying path 243 is a carrying path that extends vertically downward from the bifurcating claw 202 and performs saddle-stitching and center-folding processing on the sheet bundle.

The center-folding carrying path 243 includes a bundle carrying upper guide plate 207 that guides the sheet bundle above a folding plate 215 for center-folding, and a bundle carrying lower guide plate 208 that guides the sheet bundle below the folding plate 215. The bundle carrying upper guide plate 207 includes a bundle carrying upper roller 205, a rear-end hitting claw 221, and a bundle carrying lower roller 206 arranged thereon in order from the upper part. The rear-end hitting claw 221 is erected on a rear-end hitting claw driving belt 222 driven by a driving motor (not illustrated). The rear-end hitting claw 221 hits (presses) the rear end of the sheet bundle toward a movable fence described later due to a reciprocative rotation operation of a rear-end hitting claw driving belt 222 to perform an aligning operation of the sheet bundle. When the sheet bundle is carried in, and when the sheet bundle is moved up for center-folding, the rear-end hitting claw 221 is retracted from the center-folding carrying path 243 of the bundle carrying upper guide plate 207 (position represented by a dashed line in FIG. 1).

Reference numeral 294 denotes a rear-end hitting claw HP sensor for detecting a home position of the rear-end hitting claw 221, which detects, as the home position, the position represented by the dashed line in FIG. 1 (position represented by a solid line in FIG. 2) after retraction from the center-folding carrying path 243. The rear-end hitting claw 221 is controlled based on the home position.

The bundle carrying lower guide plate 208 includes a saddle-stitching stapler S1, a saddle-stitching jogger fence 225, and a movable fence 210 arranged thereon in order from the upper part. The bundle carrying lower guide plate 208 is a guide plate that receives the sheet bundle carried through the bundle carrying upper guide plate 207. A pair of the saddle-stitching jogger fences 225 is arranged in the width direction, a front end of the sheet bundle abuts on (is supported by) a lower part thereof, and the movable fence 210 is arranged in a vertically movable manner.

The saddle-stitching stapler S1 is a stapler that stitches the center part of the sheet bundle. The movable fence 210 moves in the vertical direction while supporting the front end of the sheet bundle, and positions the center position of the sheet bundle at a position opposed to the saddle-stitching stapler S1. At this position, staple processing, that is, the saddle-stitching is performed. The movable fence 210 is supported by a movable fence driving mechanism 210*a* and movable from a position of a movable fence HP sensor 292 illustrated in the upper part of the figure to the lowermost position. A movable range of the stroke of the movable fence 210 on which the front end of the sheet bundle abuts is secured so as to be able to process the maximum size and the minimum size that can be processed by the saddle-stitch bookbinding device 2. For example, a rack and pinion mechanism is used as the movable fence driving mechanism 210*a*.

The folding plate 215, a pair of folding rollers 230, an additional-folding roller unit 260, and a lower paper discharge roller 231 are arranged between the bundle carrying upper guide plate 207 and the bundle carrying lower guide plate 208, that is, substantially at the center part of the center-folding carrying path 243. The additional-folding roller unit 260 is configured such that the additional-folding rollers are arranged on upper and lower sides of a paper discharge carrying path between the pair of folding rollers 230 and the lower paper discharge roller 231. The folding plate 215 can reciprocate in the horizontal direction of the figure. A nip of the pair of folding rollers 230 is positioned in an operating direction of folding-operation, and a paper discharge carrying path 244 is arranged on the extended line therefrom. The lower paper discharge roller 231 is arranged on the most downstream side of the paper discharge carrying path 244, and discharges a folded sheet bundle to the rear stage.

A sheet bundle detecting sensor 291 is arranged on the lower end of the bundle carrying upper guide plate 207, and detects the front end of the sheet bundle that is carried in the center-folding carrying path 243 and passes through the center-folding position. A fold line part passage sensor 293 is arranged on the paper discharge carrying path 244, detects the front end of the center-folded sheet bundle, and recognizes passage of the folded sheet bundle.

Generally, as illustrated in the operation explanatory diagrams of FIG. 2 to FIG. 6, a saddle-stitching operation and a center-folding operation are performed in the saddle-stitch bookbinding device 2 that is configured as illustrated in FIG. 1. That is, when saddle-stitching and center-folding are selected in an operation panel (not illustrated) of the image forming apparatus PR, the sheet bundle for which saddle-stitching and center-folding are selected is guided toward the center-folding carrying path 243 due to counterclockwise deviation of the bifurcating claw 202. The bifurcating claw 202 is driven by a solenoid. Alternatively, the bifurcating claw 202 may be driven by a motor instead of the solenoid.

Figure 2:
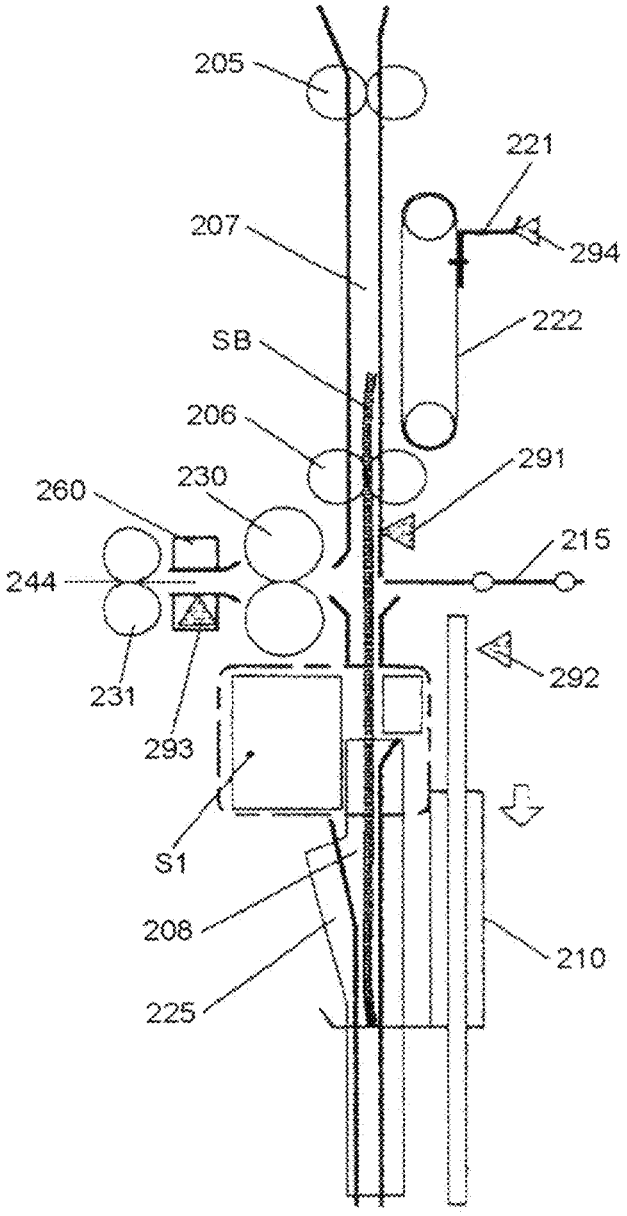
FIG. 2 is an operation explanatory diagram of a saddle-stitch bookbinding device illustrating a state of a sheet bundle when carried in a center-folding carrying path.

A sheet bundle SB carried in the center-folding carrying path 243 is carried downward in the center-folding carrying path 243 by the inlet roller 201 and the bundle carrying upper roller 205. After passage thereof is checked by the sheet bundle detecting sensor 291, the bundle carrying lower roller 206 carries the sheet bundle SB to a position at which the front end of the sheet bundle SB abuts on the movable fence 210 as illustrated in FIG. 2. At this time, the movable fence 210 stands by at different stop positions corresponding to sheet size information from the image forming apparatus PR, that is, information about a size in the carrying direction of each sheet bundle SB herein. In this case, in FIG. 2, the bundle carrying lower roller 206 holds the sheet bundle SB with the nip, and the rear-end hitting claw 221 stands by at the home position.

Figure 3:
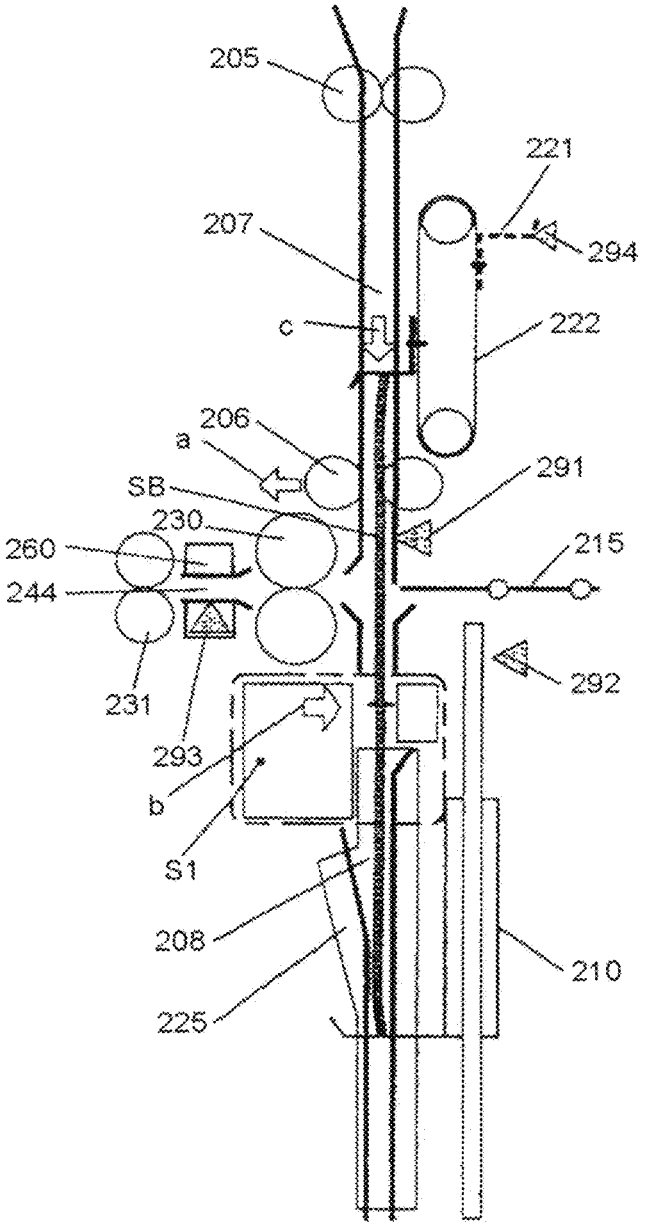
FIG. 3 is an operation explanatory diagram of the saddle-stitch bookbinding device illustrating a state of the sheet bundle during saddle stitching.

In this state, as illustrated in FIG. 3, holding pressure of the bundle carrying lower roller 206 is released (in a direction of the arrow a), the front end of the sheet bundle abuts on the movable fence 210, and the sheet bundle is stacked in a state in which the rear end thereof is free. Accordingly, the rear-end hitting claw 221 is driven, and final alignment is performed in the carrying direction by hitting the rear end of the sheet bundle SB (in a direction of the arrow c).

Subsequently, the saddle-stitching jogger fence 225 performs an aligning operation in the width direction (direction orthogonal to a sheet carrying direction). The movable fence 210 and the rear-end hitting claw 221 perform an aligning operation in the carrying direction. Accordingly, an adjusting operation of the sheet bundle SB in the width direction and the carrying direction is completed. In this case, a pushing amount of each of the rear-end hitting claw 221 and the saddle-stitching jogger fence 225 is changed and adjusted to an optimal value corresponding to size information of the sheet, information about the number of sheets of the sheet bundle, and thickness information of the sheet bundle.

Space in the carrying path is reduced when the bundle is thick, so that the sheet bundle cannot be completely adjusted in single adjusting operation in many cases. In such a case, the number of aligning operations is increased. Due to this, a better adjusted state can be achieved. Time required for sequentially overlapping the sheets on the upstream side is increased as the number of sheets increases, so that time until the next sheet bundle SB is received is prolonged. As a result, there is no time loss as a system even when the number of adjusting operations is increased, so that a good adjusted state can be efficiently achieved. Accordingly, the number of adjusting operations can be controlled depending on processing time on the upstream side.

A standby position of the movable fence 210 is normally set so that a saddle stitching position of the sheet bundle SB is opposed to a stitching position of the saddle-stitching stapler S1. This is because, when the adjusting operation is performed at this position, stitching processing can be directly performed at a stacked position without moving the movable fence 210 to the saddle stitching position of the sheet bundle SB. At this standby position, a stitcher of the saddle-stitching stapler S1 is driven in a direction of the arrow b at the center part of the sheet bundle SB, stitching processing is performed between the stitcher and a clincher, and the sheet bundle SB is saddle-stitched.

The movable fence 210 is positioned by pulse control from the movable fence HP sensor 292, and the rear-end hitting claw 221 is positioned by pulse control from the rear-end hitting claw HP sensor 294. Positioning control of the movable fence 210 and the rear-end hitting claw 221 is performed by a central processing unit (CPU) of a control circuit (not illustrated) of the saddle-stitch bookbinding device 2.

Figure 4:
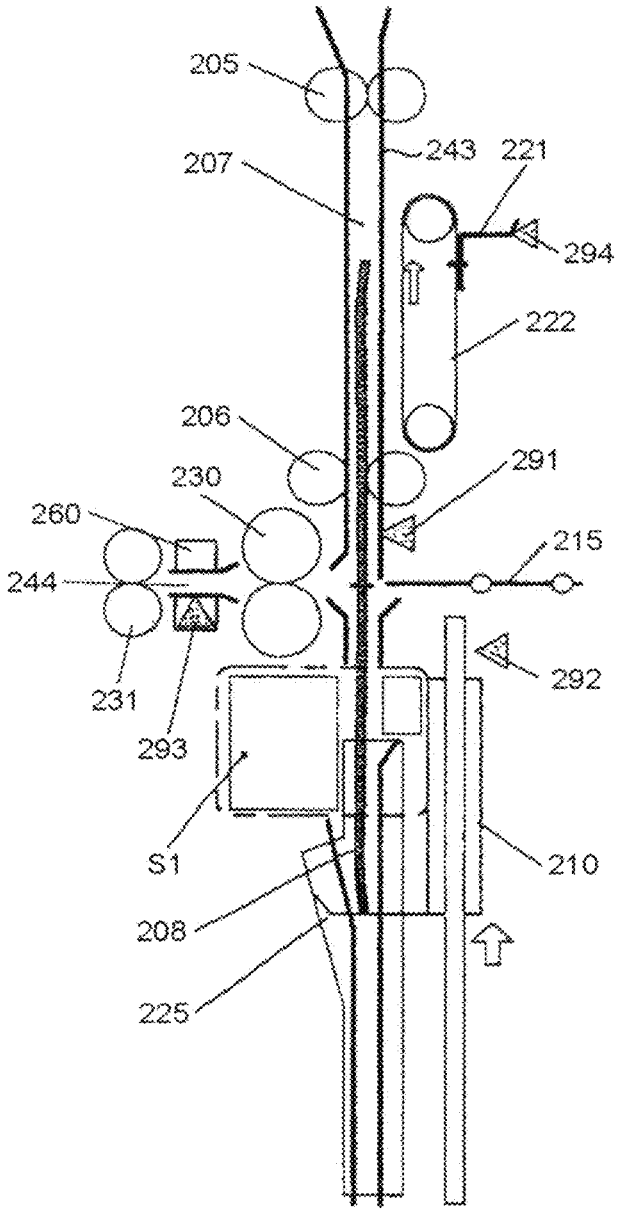
FIG. 4 is an operation explanatory diagram of the saddle-stitch bookbinding device illustrating a state in which the sheet bundle is completely moved to a center-folding position.

The sheet bundle SB saddle-stitched in the state of FIG. 3 is transferred, as illustrated in FIG. 4, to a position where the saddle stitching position (center position in the carrying direction of the sheet bundle SB) is opposed to the folding plate 215 corresponding to upward movement of the movable fence 210 in a state in which pressurization by the bundle carrying lower roller 206 is released. This position is also controlled based on a detection position of the movable fence HP sensor 292.

Figure 5:
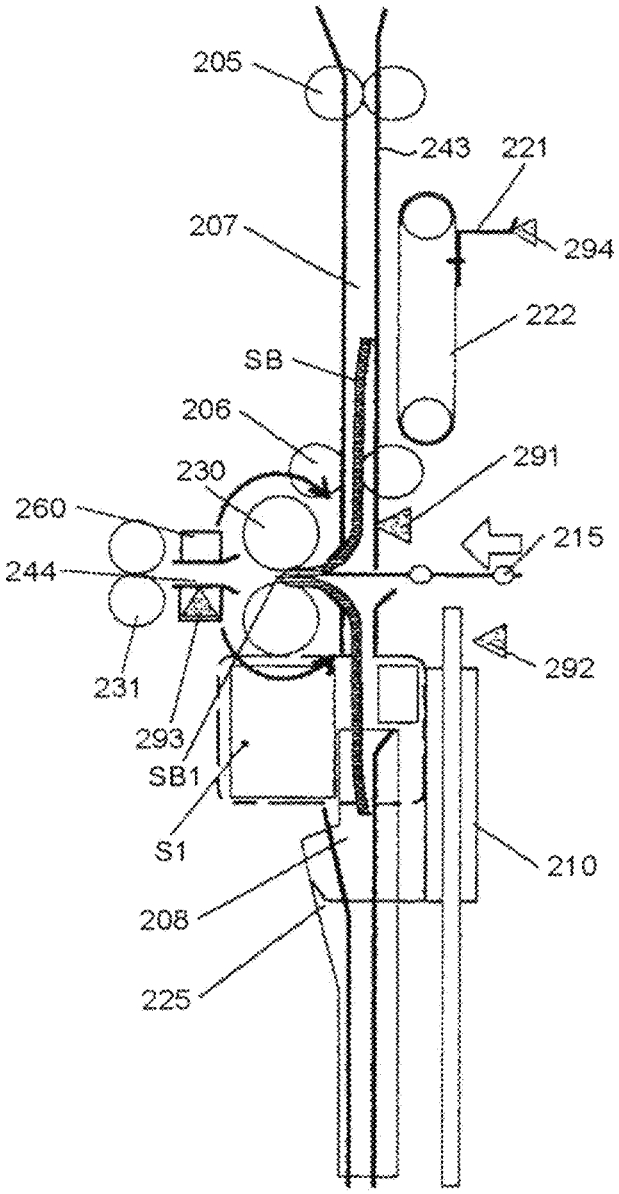
FIG. 5 is an operation explanatory diagram of the saddle-stitch bookbinding device illustrating a state in which center-folding processing is performed on the sheet bundle.

When the sheet bundle SB reaches the position of FIG. 4, as illustrated in FIG. 5, the folding plate 215 moves in a nip direction of the pair of folding rollers 230, abuts on the sheet bundle SB in the vicinity of a stapled portion thereof from a substantially orthogonal direction, and pushes out the sheet bundle SB to the nip side. The sheet bundle SB is pushed by the folding plate 215, guided to the nip of the pair of folding rollers 230, and pushed in the nip of the pair of folding rollers 230 that has been rotated in advance. The pair of folding rollers 230 pressurizes and carries the sheet bundle SB pushed in the nip. With this pressurizing and carrying operation, the center of the sheet bundle SB is folded and a simply bound sheet bundle SB is formed. FIG. 5 illustrates a state in which the front end of a fold line part SB1 of the folded sheet bundle SB is held and pressurized by the nip of the pair of folding rollers 230.

Figure 6:
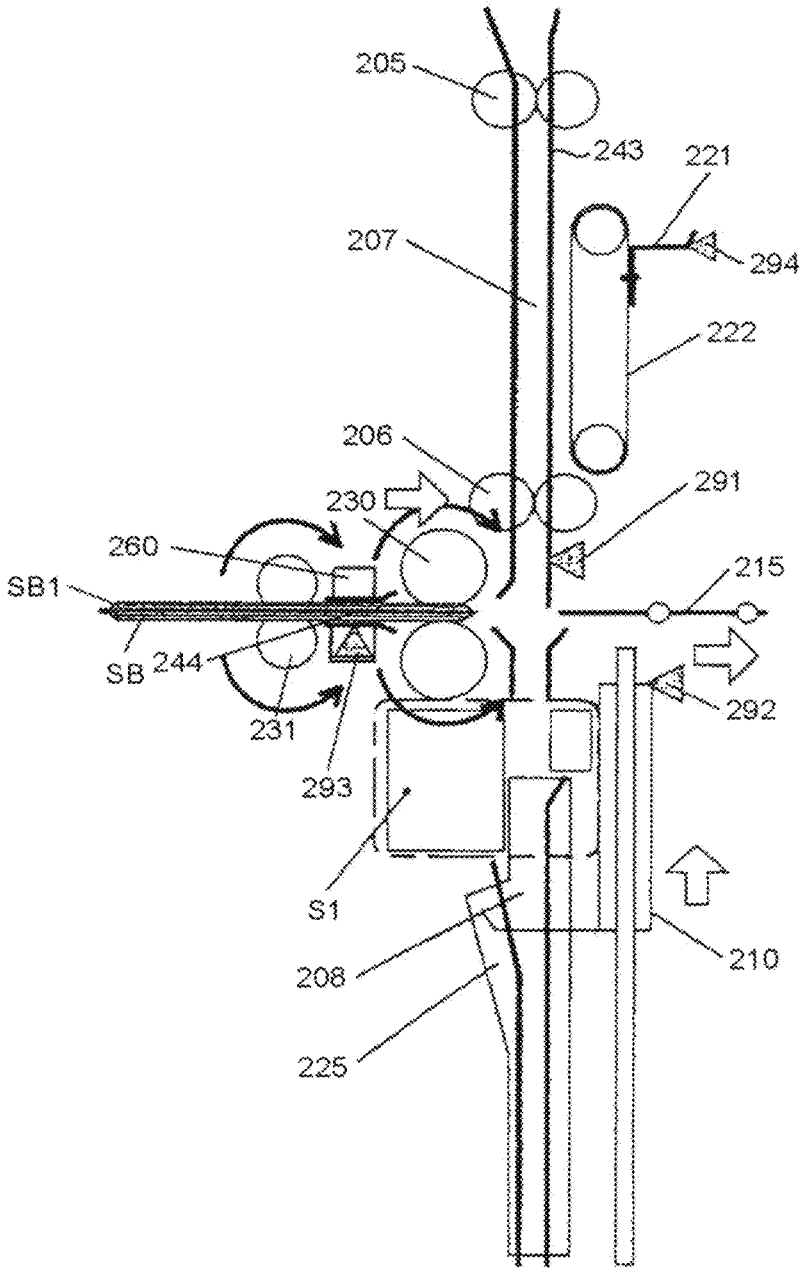
FIG. 6 is an operation explanatory diagram of the saddle-stitch bookbinding device illustrating a state of the sheet bundle discharged after the center-folding is finished.

The sheet bundle SB folded in two at the center part in the state of FIG. 5 is carried by the pair of folding rollers 230 as the folded sheet bundle SB as illustrated in FIG. 6, held by the lower paper discharge roller 231, and discharged to the rear stage. In this case, when the rear end of the folded sheet bundle SB is detected by the fold line part passage sensor 293, the folding plate 215 and the movable fence 210 are returned to the home position and the bundle carrying lower roller 206 is returned to the pressurizing state to prepare for the next sheet bundle SB to be carried in. When the size and the number of sheets of the next job are the same, the movable fence 210 may move to the position of FIG. 2 again to stand by. These control processes are also performed by the CPU of the control circuit.

Figure 7:
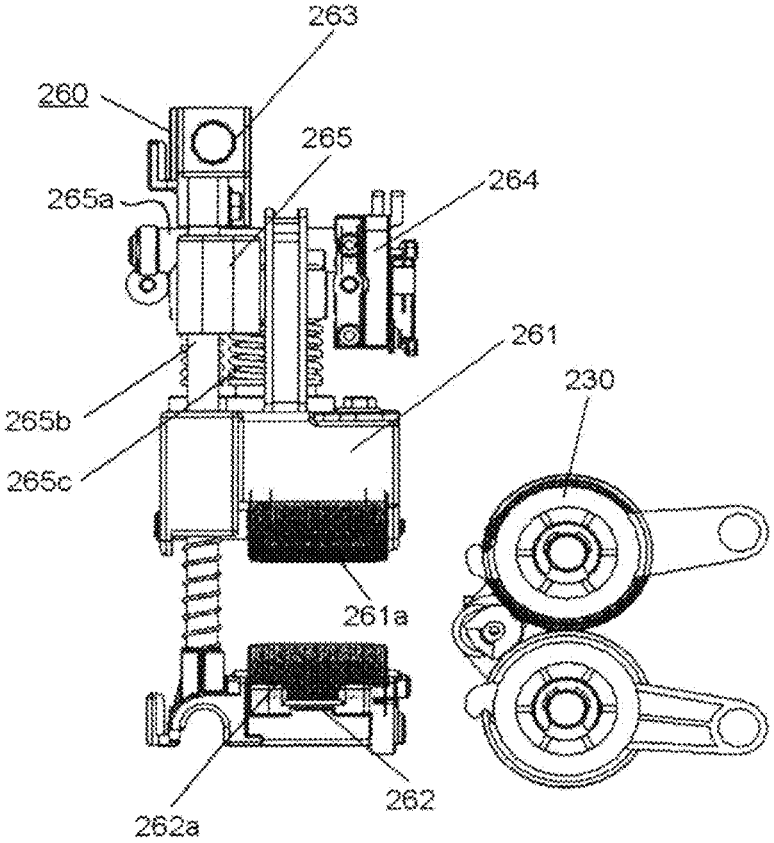
FIG. 7 is a front view of a principal part illustrating an additional-folding roller unit and a pair of folding rollers.
Figure 8:
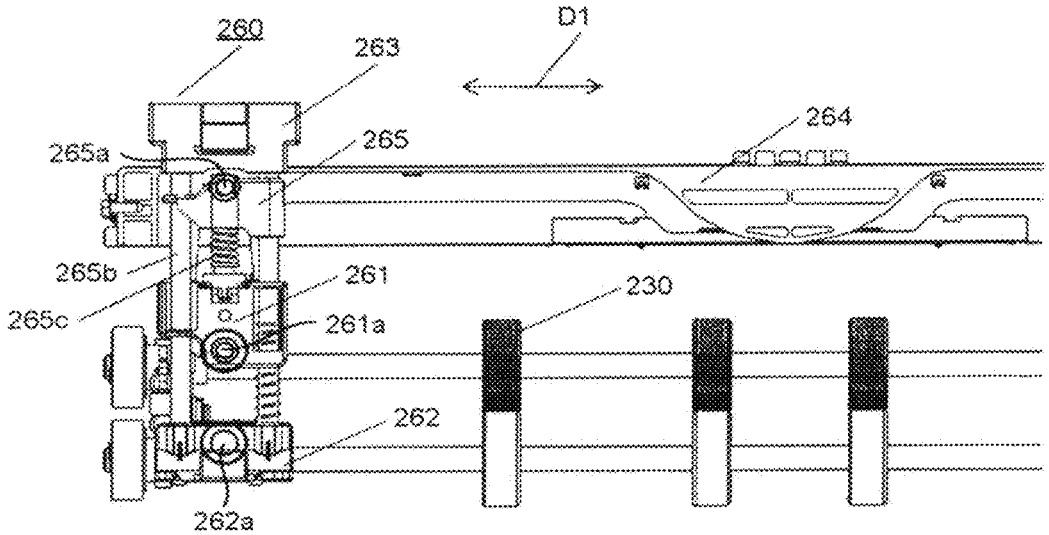
FIG. 8 is a side view of the principal part viewed from the left side of FIG. 7.

FIG. 7 is a front view of a principal part illustrating the additional-folding roller unit and the pair of folding rollers, and FIG. 8 is a side view of the principal part viewed from the left side of FIG. 7. The additional-folding roller unit 260 is arranged in the paper discharge carrying path 244 between the pair of folding rollers 230 and the lower paper discharge roller 231, and includes a unit moving mechanism 263, a guide member 264, and a pressing mechanism 265. The unit moving mechanism 263 reciprocates the additional-folding roller unit 260 in the depth direction of the figure (direction orthogonal to the sheet carrying direction) along the guide member 264 with a driving source and a driving mechanism (not illustrated). The pressing mechanism 265 is a mechanism that applies a pressure in the vertical direction to press the folded sheet bundle SB, and includes an upper additional-folding roller unit 261 and a lower additional-folding roller unit 262.

The upper additional-folding roller unit 261 is supported by the unit moving mechanism 263 with a support member 265*b* to be movable in the vertical direction, and the lower additional-folding roller unit 262 is mounted to the lower end of the support member 265*b* of the pressing mechanism 265 so as not to be movable. The upper additional-folding roller

261*a* of the upper additional-folding roller unit 261 can be in press-contact with the lower additional-folding roller 262*a*, and the center-folded sheet bundle SB is held and pressurized in their nip. The pressurizing force is given by a pressurizing spring 265*c* that pressurizes the upper additional-folding roller unit 261 with an elastic force. The upper additional-folding roller unit 261 moves in the width direction (direction of the arrow D1 in FIG. 8) of the sheet bundle SB as described later in the pressurized state, and performs additional-folding on the fold line part SB1.

Figure 9:
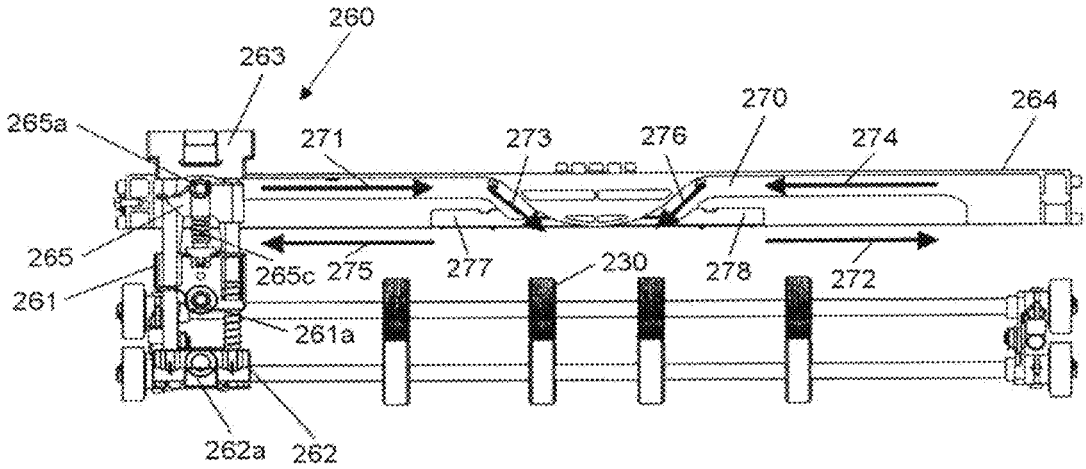
FIG. 9 is a diagram illustrating details about a guide member.

FIG. 9 is a diagram illustrating details about the guide member 264. The guide member 264 includes a guiding path 270 that guides the additional-folding roller unit 260 in the width direction of the center-folded sheet bundle SB. Six paths are set in the guiding path 270 as follows:

1) a first guiding path 271 that guides the pressing mechanism 265 in a press-releasing state in forward movement;

2) a second guiding path 272 that guides the pressing mechanism 265 in a pressing state in forward movement;

3) a third guiding path 273 that switches the pressing mechanism 265 from the press-releasing state to the pressing state in forward movement;

4) a fourth guiding path 274 that guides the pressing mechanism 265 in the press-releasing state in backward movement;

5) a fifth guiding path 275 that guides the pressing mechanism 265 in the pressing state in backward movement; and 6) a sixth guiding path 276 that switches the pressing mechanism 265 from the press-releasing state to the pressing state in backward movement.

Figure 10:
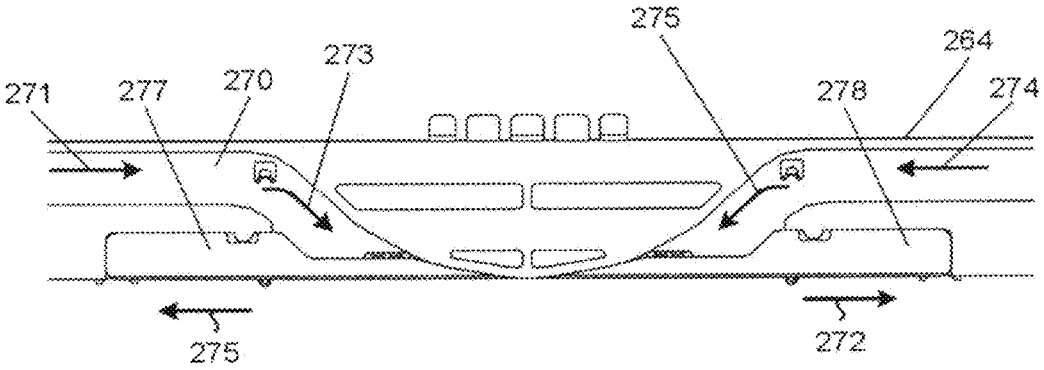
FIG. 10 is an enlarged view of the principal part of FIG. 9 illustrating a state in which a path switching claw is not switched.
Figure 11:
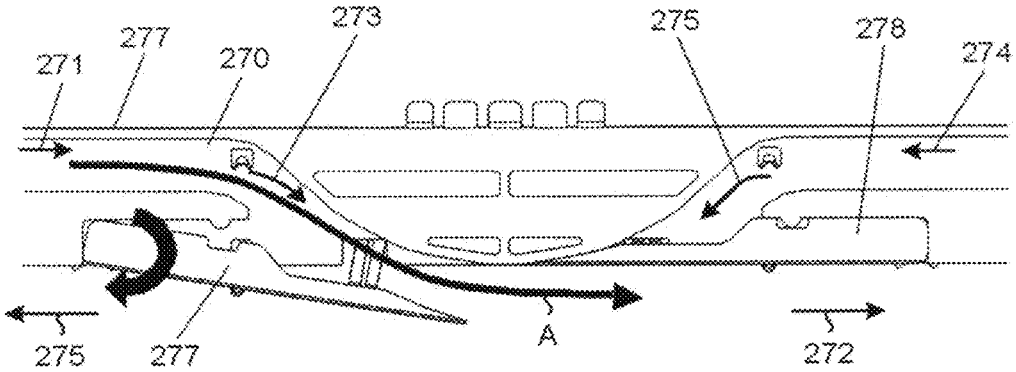
FIG. 11 is an enlarged view of the principal part of FIG. 9 illustrating a state in which a first path switching claw is switched.

FIG. 10 and FIG. 11 are enlarged views of the principal part of FIG. 9. As illustrated in FIG. 10 and FIG. 11, a first path switching claw 277 is arranged at an intersection point between the third guiding path 273 and the second guiding path 272, and a second path switching claw 278 is arranged at an intersection point between the sixth guiding path 276 and the fifth guiding path 275. As illustrated in FIG. 11, the first path switching claw 277 can switch the third guiding path 273 to the second guiding path 272, and the second path switching claw 278 can switch the sixth guiding path 276 to the fifth guiding path 275. However, in the former case, the second guiding path 272 cannot be switched to the third guiding path 273. In the latter case, the fifth guiding path 275 cannot be switched to the sixth guiding path 276. That is, switching cannot be performed in a reverse direction. An arrow A in FIG. 11 represents a movement track of a guide pin 265*a* from the first guiding path 271 to the second guiding path 272.

The pressing mechanism 265 moves along the guiding path 270 because the guide pin 265*a* of the pressing mechanism 265 is movably engaged in the guiding path 270 in a loosely fitted state. That is, the guiding path 270 functions as a cam groove, and the guide pin 265*a* functions as a cam follower to be displaced while moving along the cam groove.

FIG. 12 to FIG. 22 are operation explanatory diagrams of the additional-folding operation by the additional-folding roller unit according to the embodiment.

Figure 12:
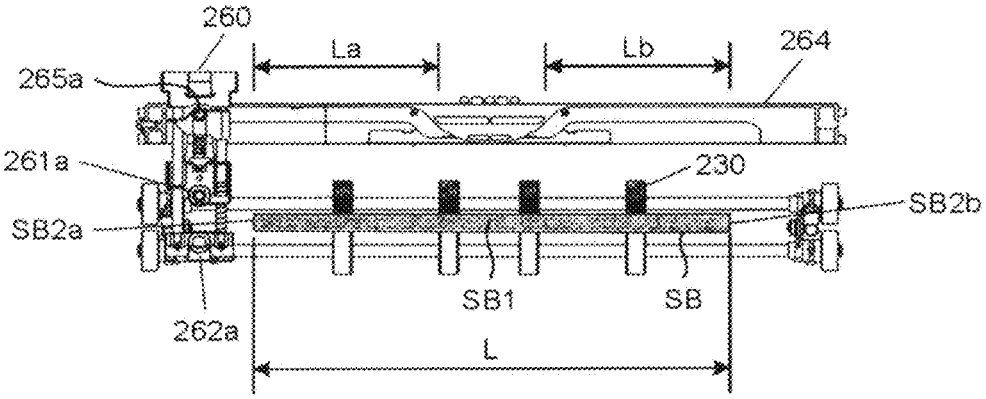
FIG. 12 is an operation explanatory diagram illustrating an initial state of an additional-folding operation.

FIG. 12 illustrates a state in which the sheet bundle SB folded by the pair of folding rollers 230 is carried and stopped at an additional-folding position set in advance, and the additional-folding roller unit 260 is at a standby position. This state is an initial position of the additional-folding operation. In addition, in FIG. 12, SB2*a* represents one end of the center-folded sheet bundle SB, and SB2*b* represents another end of the center-folded sheet bundle SB.

Figure 13:
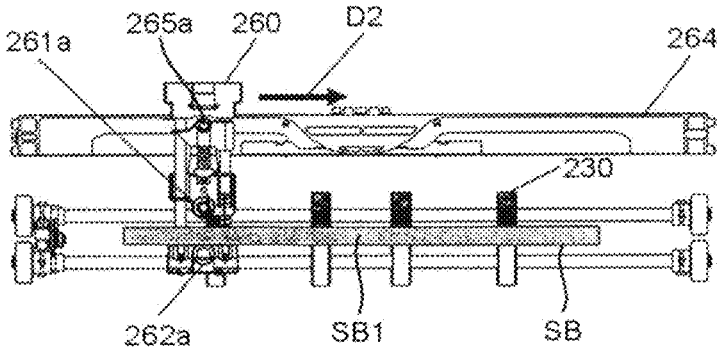
FIG. 13 is an operation explanatory diagram illustrating a state in which forward movement of the additional-folding roller unit is started.
Figure 14:
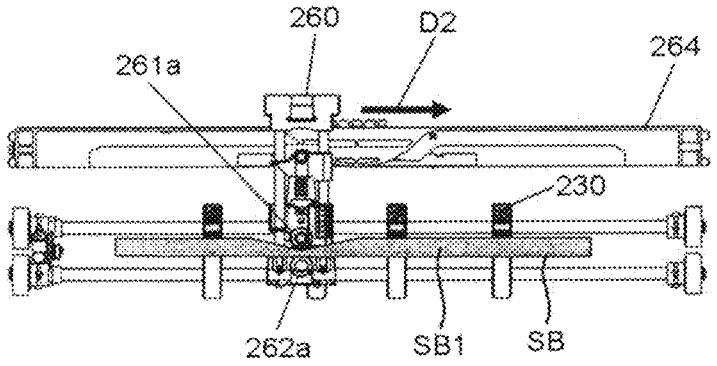
FIG. 14 is an operation explanatory diagram illustrating a state in which the additional-folding roller unit comes to a third guiding path near the center of the sheet bundle.

The additional-folding roller unit 260 starts to move forward in the right direction of the figure (direction of the arrow D2) from the initial position (the state shown in FIG. 12 to the state shown in FIG. 13). In this case, the pressing mechanism 265 in the additional-folding roller unit 260 moves along the guiding path 270 of the guide member 264 due to action of the guide pin 265*a*. The pressing mechanism 265 moves along the first guiding path 271 immediately after the operation start. At this time, the pair of additional-folding rollers 261*a* and 262*a* is in a press-releasing state. The press-releasing state means a state in which the pair of additional-folding rollers 261*a* and 262*a* and the center-folded sheet bundle SB are in contact with each other but little pressure is applied thereto, or a state in which the pair of additional-folding rollers 261*a* and 262*a* and the center-folded sheet bundle SB are separated from each other. The pair of additional-folding rollers 261*a* and 262*a* is configured by the upper additional-folding roller 261*a* and the lower additional-folding roller 262*a* to be paired with each other.

Figure 15:
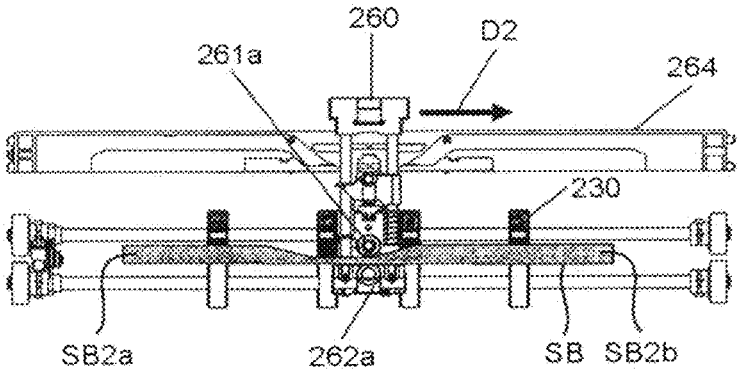
FIG. 15 is an operation explanatory diagram illustrating a state in which the additional-folding roller unit pushes aside the first path switching claw and enters a second guiding path.

When coming to the third guiding path 273 near the center of the center-folded sheet bundle SB (FIG. 14), the pressing mechanism 265 starts to descend along the third guiding path 273, pushes aside the first path switching claw 277, and enters the second guiding path 272 (FIG. 15). At this time, the pressing mechanism 265 is in a state of pressing the upper additional-folding roller unit 261, and the upper additional-folding roller unit 261 abuts on the center-folded sheet bundle SB to be in a pressing state.

Figure 16:
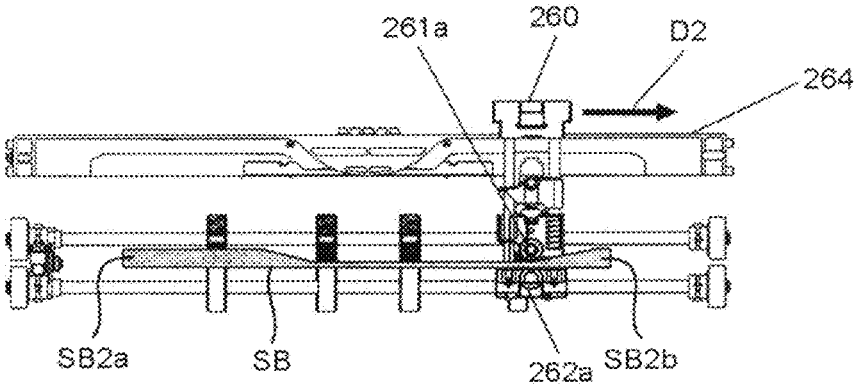
FIG. 16 is an operation explanatory diagram illustrates a state in which the additional-folding roller unit moves in an end direction while pressing the sheet bundle.
Figure 17:
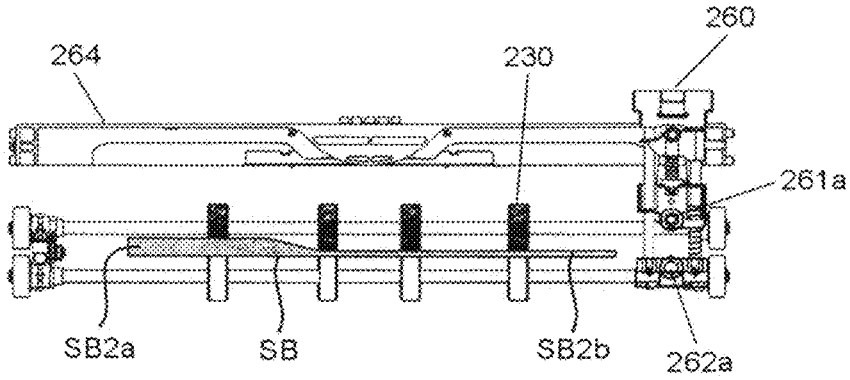
FIG. 17 is an operation explanatory diagram illustrating a state in which the additional-folding roller unit moves to a final position of the forward movement along the second guiding path.

The additional-folding roller unit 260 further moves in the direction of the arrow D2 while keeping the pressing state (FIG. 16). Because the second path switching claw 278 cannot move in the reverse direction, the additional-folding roller unit 260 moves along the second guiding path 272 without being guided to the sixth guiding path 276, passes through the end SB2*b* of the center-folded sheet bundle SB, and reaches the final position of the forward movement (FIG. 17). After moving to this position, the guide pin 265*a* of the pressing mechanism 265 is moved from the second guiding path 272 to the upper fourth guiding path 274. As a result, position regulation of the guide pin 265*a* by an upper surface of the second guiding path 272 is released, so that the upper additional-folding roller 261*a* moves away from the lower additional-folding roller 262*a* to be in the press-releasing state.

Figure 18:
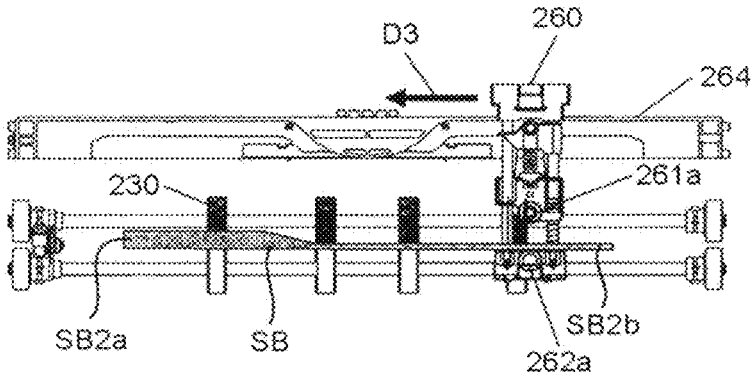
FIG. 18 is an operation explanatory diagram illustrating a state in which the additional-folding roller unit starts backward movement from the final position of the forward movement.
Figure 19:
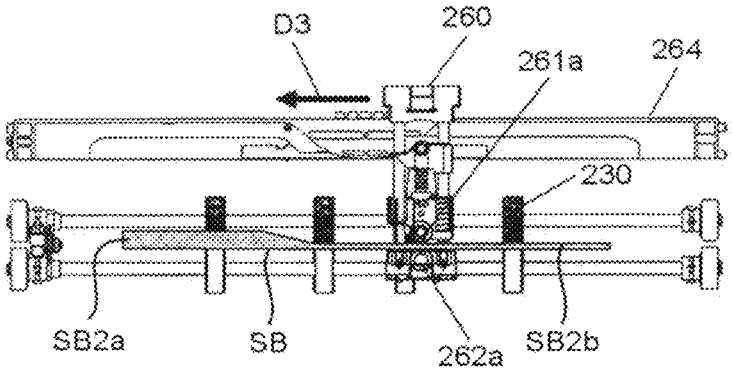
FIG. 19 is an operation explanatory diagram illustrating a state in which the additional-folding roller unit starts backward movement and reaches a sixth guiding path.
Figure 20:
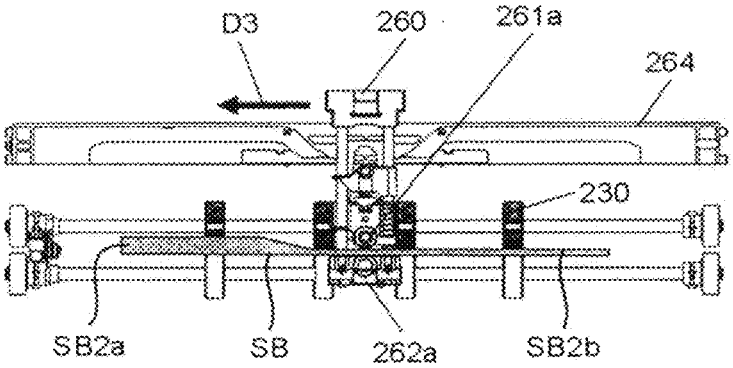
FIG. 20 is an operation explanatory diagram illustrating a state in which the additional-folding roller unit reaches the sixth guiding path and shifts from a press-releasing state to a pressing state.
Figure 21:
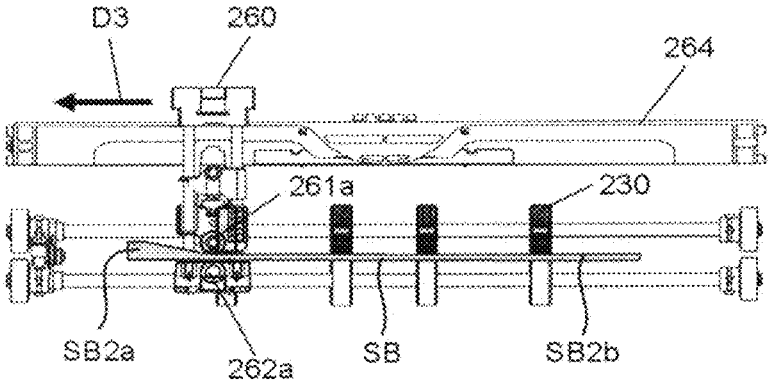
FIG. 21 is an operation explanatory diagram illustrating a state of completely pressing state when the additional-folding roller unit enters a fifth guiding path.

Subsequently, the additional-folding roller unit 260 starts to move backward with the unit moving mechanism 263 (FIG. 18). In the backward movement, the pressing mechanism 265 moves along the fourth guiding path 274 in the left direction of the figure (direction of the arrow D3). When the pressing mechanism 265 reaches the sixth guiding path 276 due to this movement (FIG. 19), the guide pin 265*a* is pushed downward along the shape of the sixth guiding path 276, and the pressing mechanism 265 is shifted from the press-releasing state to the pressing state (FIG. 20).

Figure 22:
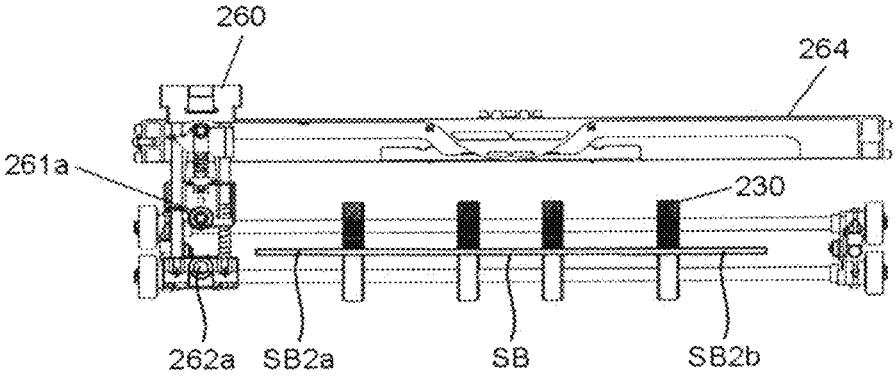
FIG. 22 is an operation explanatory diagram illustrating a state in which the additional-folding roller unit moves in the fifth guiding path as it is and returns to an initial position.

When entering the fifth guiding path 275, the pressing mechanism 265 is in a completely pressing state, and moves through the fifth guiding path 275 as it is in the direction of the arrow D3 (FIG. 21) to pass through the end SB2*a* of the sheet bundle SB (FIG. 22).

The additional-folding roller unit 260 is reciprocated as described above to additionally fold the center-folded sheet bundle SB. In this case, the additional-folding roller unit 260 starts additional-folding from the center part of the center-folded sheet bundle SB to one side, and passes through one end SB2*b* of the center-folded sheet bundle SB. After that, additional-folding is performed such that the additional-folding roller unit 260 passes over the additionally folded part of the center-folded sheet bundle SB, starts additional-folding from the center part of the center-folded sheet bundle to the other side, and passes through the other end SB2*a*.

With such an operation, the pair of additional-folding rollers 261*a* and 262*a* do not come into contact with or pressurize the ends SB2*a* and SB2*b* of the center-folded sheet bundle SB from the outside of the center-folded sheet bundle SB when the additional-folding is started or when the additional-folding roller unit 260 passes through the one end SB2*b* and returns to the other end SB2*a*. That is, when passing through the ends SB2*a* and SB2*b* of the center-folded sheet bundle SB from the outside of the ends, the additional-folding roller unit 260 is in the press-releasing state. Due to this, no damage is caused to the ends SB2*a* and SB2*b* of the center-folded sheet bundle SB. In the present embodiment, because the additional-folding is performed from near the center part of the center-folded sheet bundle SB toward the ends SB2*a* and SB2*b* inside the ends SB2*a* and SB2*b* of the center-folded sheet bundle SB, a distance of traveling on the center-folded sheet bundle SB in a contact manner becomes short in additional-folding, so that twists that cause wrinkles and the like are hardly accumulated. Accordingly, no damage is caused to the ends SB2*a* and SB2*b* of the center-folded sheet bundle SB when the fold line part (spine) SB1 of the center-folded sheet bundle SB is additionally folded, so that it is possible to prevent curling up or wrinkles from being caused at the fold line part SB1 and the vicinity thereof due to accumulation of twists.

To prevent the upper additional-folding roller 261*a* and the first and the second lower additional-folding rollers 262*a* and 262*b* from running onto the end SB2*a* or SB2*b* from the outside of the end SB2*a* or SB2*b* of the center-folded sheet bundle SB, the operation is performed as shown by FIG. 12 to FIG. 22. That is, as shown in FIG. 12, when La represents a distance by which the additional-folding roller unit 260 moves over the center-folded sheet bundle in the press-releasing state in forward movement, and Lb represents a distance by which the additional-folding roller unit 260 moves over the center-folded sheet bundle SB in the press-releasing state in backward movement, a relation between the length L in the width direction of the center-folded sheet bundle and the distances La and Lb needs to satisfy L>La+Lb (FIG. 12 to FIG. 14, and FIG. 17 to FIG. 19).

It is preferable that the distances La and Lb are set to be substantially the same, and pressing is started near the center part in the width direction of the center-folded sheet bundle SB (FIG. 16 and FIG. 20).

In the additional-folding roller unit 260 according to the embodiment, the lower additional-folding roller unit 262 is prepared to perform additional-folding with the pair of additional-folding rollers 261*a* and 262*a*. Alternatively, the lower additional-folding roller unit 262 may be removed, and the upper additional-folding roller unit 261 and a receiving member (not illustrated) having an abutting surface opposed thereto may be provided to perform pressing therebetween.

In the additional-folding roller unit 260 according to the embodiment, the upper additional-folding roller unit 261 is configured to be movable in the vertical direction and the lower additional-folding roller unit 262 is configured not to be movable in the vertical direction. Alternatively, the lower additional-folding roller unit 262 can also be configured to be movable in the vertical direction. With such a configuration, the pair of additional-folding rollers 261*a* and 262*a* symmetrically perform a contacting/separating operation with respect to the additional-folding position. Accordingly, the additional-folding position is constant regardless of the thickness of the sheet bundle SB, so that the damage such as a scratch can be further prevented.

Figure 23:
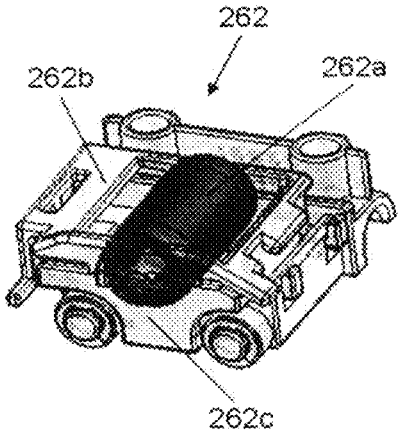
FIG. 23 is a diagram illustrating a configuration of an additional-folding unit.
Figure 24:
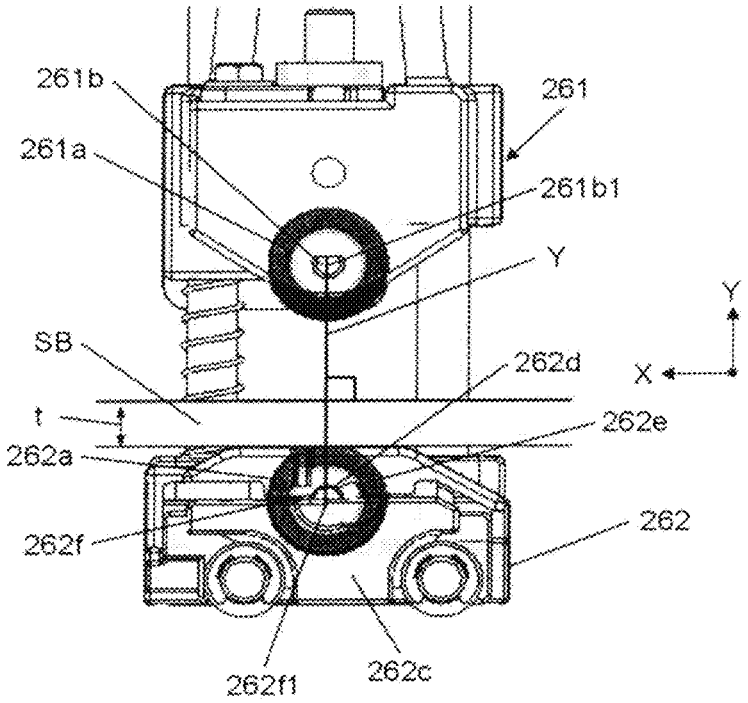
FIG. 24 is a diagram illustrating a positional relation corresponding to a first position between a traveling direction of the additional-folding unit and upper and lower additional-folding rollers.
Figure 25:
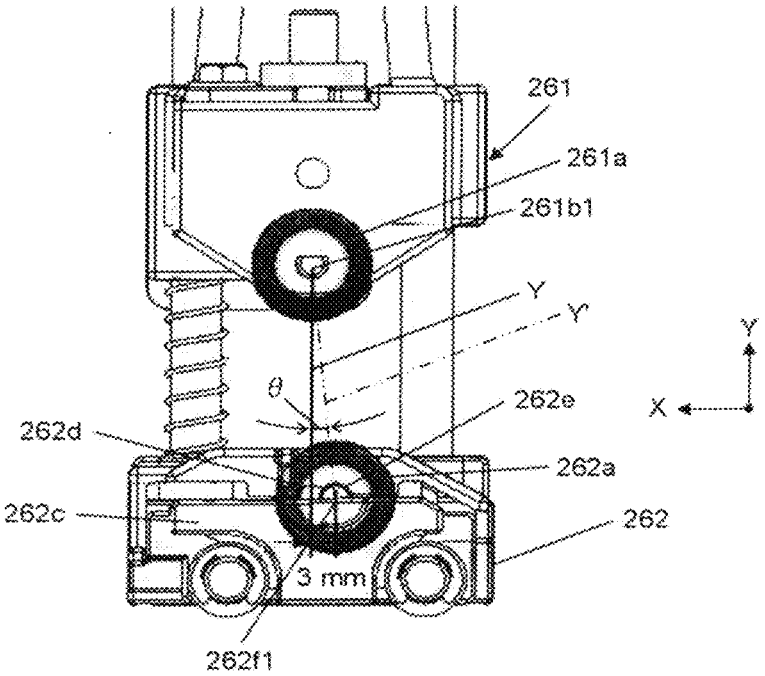
FIG. 25 is a diagram illustrating a positional relation corresponding to a second position between the traveling direction of the additional-folding unit and the upper and the lower additional-folding rollers.
Figure 26:
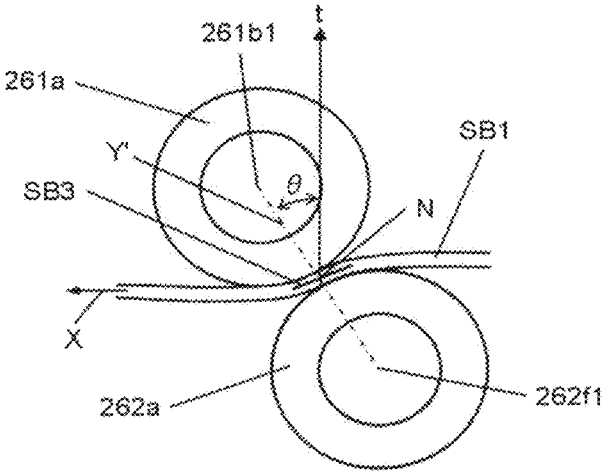
FIG. 26 is a diagram illustrating a state in which a staple and a pair of additional-folding rollers in additional-folding are at the first position, and the staple is positioned at the center of the sheet bundle.

FIG. 23 is a diagram illustrating a configuration of the additional-folding roller unit 260, and FIGS. 24 and 25 are diagrams illustrating a positional relation between a traveling direction of the additional-folding roller unit 260 and the pair of upper and lower additional-folding rollers 261*a* and 262*a*. The lower additional-folding roller unit 262 includes, as illustrated in FIG. 23, a lower additional-folding roller 262*a*, a cover 262*b*, and a lower additional-folding roller case 262*c*. The lower additional-folding roller 262*a* is rotatably supported by the lower additional-folding roller case 262*c*.

As illustrated in FIG. 24 and FIG. 25, two bearings are provided to the lower additional-folding roller case 262*c*. That is, a first bearing 262*d* and a second bearing 262*e* are provided. The first bearing 262*d* is at a position where a straight line Y connecting center axes 261*b*1 and 262*f*1 of rotation axes 261*b* and 262*f* of the pair of additional-folding rollers (upper and lower additional-folding rollers) 261*a* and 262*a* is parallel to the thickness direction t of the center-folded sheet bundle SB. FIG. 24 is a diagram illustrating this state. FIG. 24 illustrates an initial state of the center-folded sheet bundle SB before pressing is started. The upper additional-folding roller 261*a* descends from the initial state and holds the sheet bundle SB with the lower additional-folding roller 262*a* at the first position. The traveling direction of the lower additional-folding roller unit 262 (X-direction in FIG. 24) in the first position corresponds to a tangential direction of a nip N between the pair of additional-folding rollers 261*a* and 262*a*.

The second bearing 262*e* is arranged, as illustrated in FIG. 25, at a position shifted from the position of the first bearing 262*d* illustrated in FIG. 24 to the upstream side by 3 mm in a forward moving direction. Accordingly, when the lower additional-folding roller 262*a* is moved to the second bearing 262*e*, a straight line Y' connecting the centers 261*b*1 and 262*f*1 of the rotation axes of both rollers is inclined with respect to the straight line Y (by angle θ) as compared to the case in which the lower additional-folding roller 262*a* is positioned at the first bearing 262*d*.

FIGS. 26 to 29 are diagrams illustrating a relation between the staple and the pair of additional-folding rollers 261*a* and 262*a* in additional-folding. As seen from FIG. 26, when the pair of additional-folding rollers 261*a* and 262 holds the center-folded sheet bundle SB in the nip N therebetween for additional-folding, the straight line Y' is inclined by angle θ with respect to the straight line Y (sheet thickness direction t). Accordingly, a pressing force is applied to a fold line part SB1 of the center-folded sheet bundle SB in a state in which the pressing force is inclined with respect to a width direction X (or the traveling direction of the additional-folding roller unit 260). Due to this, the fold is reinforced as compared to the case illustrated in FIG. 24.

Figure 27:
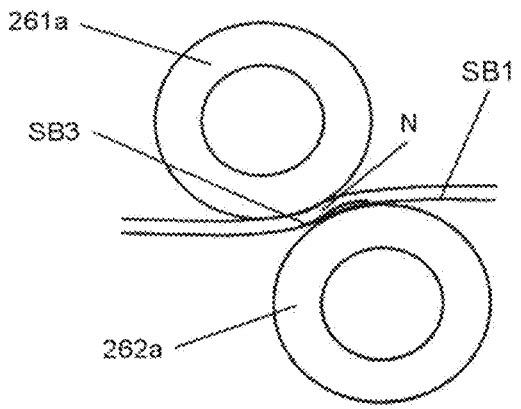
FIG. 27 is a diagram illustrating a state in which the staple and the pair of additional-folding rollers in additional-folding are at the first position, and the staple is positioned on a lower additional-folding roller side of the sheet bundle.
Figure 28:
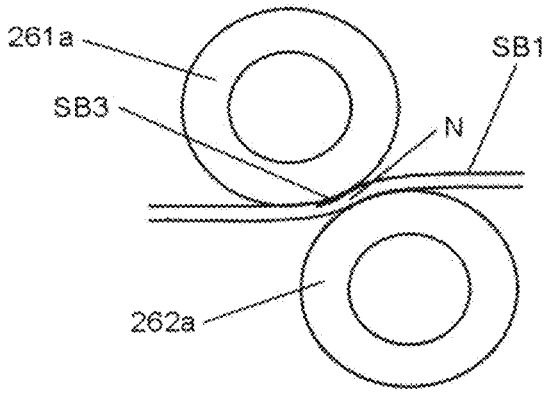
FIG. 28 is a diagram illustrating a state in which the staple and the pair of additional-folding rollers in additional-folding are at the first position, and the staple is positioned on an upper additional-folding roller side of the sheet bundle.

At this second position, a staple SB3 is easily deformed when the staple SB3 is at a position in contact with the lower additional-folding roller 262*a* as illustrated in FIG. 27, or when the staple SB3 is at a position in contact with the upper additional-folding roller 261*a* as illustrated in FIG. 28. This is because the force is directly applied to the staple SB3 from the lower additional-folding roller 262*a* or the upper additional-folding roller 261*a*. When the staple SB3 is deformed in this way, a portion of the fold line part SB1 of the sheet bundle SB stitched with the staple SB3 is deformed, and folding quality is deteriorated.

Figure 29:
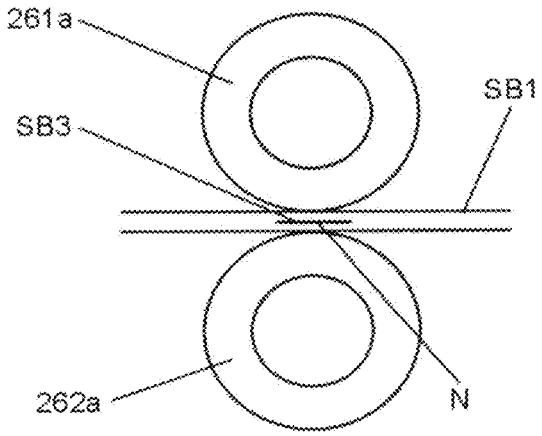
FIG. 29 is a diagram illustrating a state in which the staple and the pair of additional-folding rollers in additional-folding are at the second position, and the staple is positioned at the center of the sheet bundle.

When there is a problem in the folding quality, the position of the lower additional-folding roller 262*a* is changed to the first bearing 262*d* where the angle θ is 0° as illustrated in FIG. 24. This position is the first position. Accordingly, a force for bending the staple SB3 is not applied as illustrated in FIG. 29, so that the portion of the fold line part SB1 of the center-folded sheet bundle SB stitched with the staple SB3 is not deformed. Due to this, high folding quality can be ensured.

In the embodiment, two bearings are provided to the lower additional-folding roller case 262*c*. Alternatively, three bearings may be provided, even to the upper additional-folding roller unit 261 side. In the embodiment, the second bearing 262*e* is arranged on the upstream side by 3 mm in the forward moving direction. Alternatively, the second bearing 262*e* may be arranged on the downstream side. A distance between the first bearing 262*d* and the second bearing 262*e* is not limited to 3 mm. The distance may be larger than or smaller than 3 mm.

Figure 30:
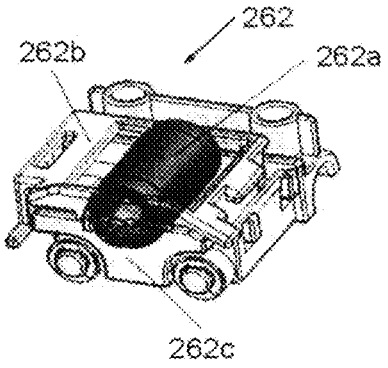
FIGS. 30(*a*) to 30(*d*) are diagrams schematically illustrating an example in which a user moves the lower additional-folding roller by oneself.
Figure 30:
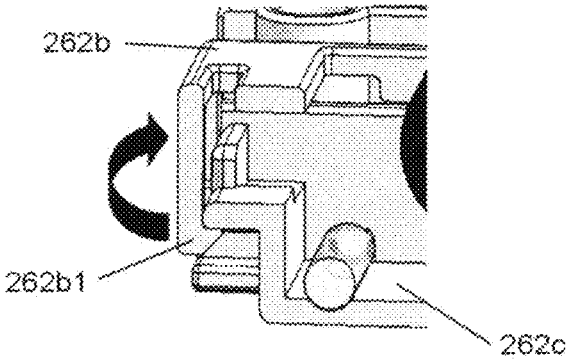
Figure 30:
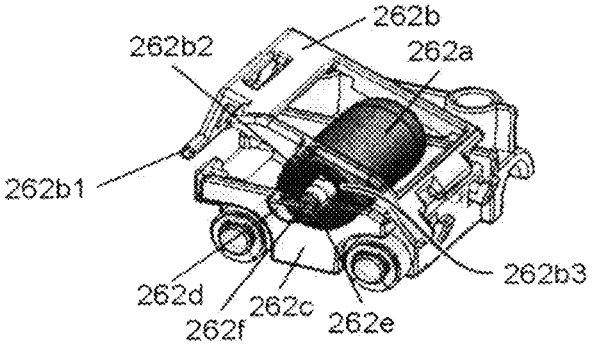
Figure 30:
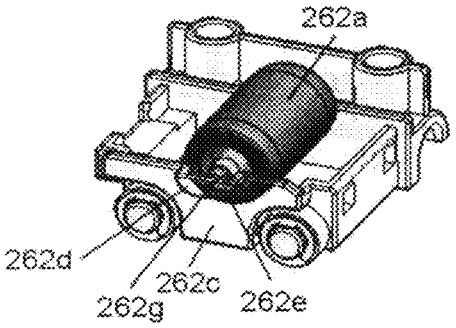

FIGS. 30(*a*) to 30(*d*) are explanatory diagrams illustrating an operation procedure for moving the lower additional-folding roller 262*a* from the first bearing 262*d* to the second bearing 262*e*.

FIG. 30(*a*) illustrates an initial state, which is the same as the diagram illustrated in FIG. 23. In this state, the lower additional-folding roller 262*a* is mounted to the first bearing 262*d*. As illustrated in FIG. 30(*b*), an engaging piece 262*b*1 is arranged on the outside of the cover 262*b*, the engaging piece 262*b*1 being engaged with (hereinafter, referred to as engagement) the lower additional-folding roller case 262*c* to elastically connect the cover 262*b* and the lower additional-folding roller case 262*c*. FIG. 30(*b*) illustrates a state in which the engaging piece 262*b*1 is engaged with the lower additional-folding roller case 262*c*, the cover 262*b* is locked to the lower additional-folding roller case 262*c*, and the lower additional-folding roller 262*a* is rotatably held by the first bearing 262*d*.

From this state, an operation is performed as represented by the arrow in FIG. 30(*b*) to release an elastically engaged state of the engaging piece 262*b*1 with respect to the lower additional-folding roller case 262*c*. Accordingly, the cover 262*b* is opened as illustrated in FIG. 30(*c*), and the rotation axes 262*f* of the lower additional-folding roller 262*a* can be moved from the first bearing 262*d* to the second bearing 262*e*. The cover 262*b* is integrally molded using material having elasticity such as polyoxymethylene (POM: polyacetal) to enable elastic engagement.

In this way, the lower additional-folding roller 262*a* is removably attached to the lower additional-folding roller case 262*c*, so that the user can select to put emphasis on reinforcing the fold or to put emphasis on preventing the deformation of the staple by changing the bearing position, for example. The additional-folding roller can be replaced when being worn out. FIGS. 30© and 30(*d*) illustrate a state after the lower additional-folding roller 262*a* is moved to the second bearing 262*e*.

The first and the second bearings 262*d* and 262*e* are configured to be paired with the bearings 262*b*2 and 262*b*3 on the cover 262*b* side, and the first and the second bearings 262*d* and 262*e* are opened when the cover 262*b* is opened.

Figure 31:
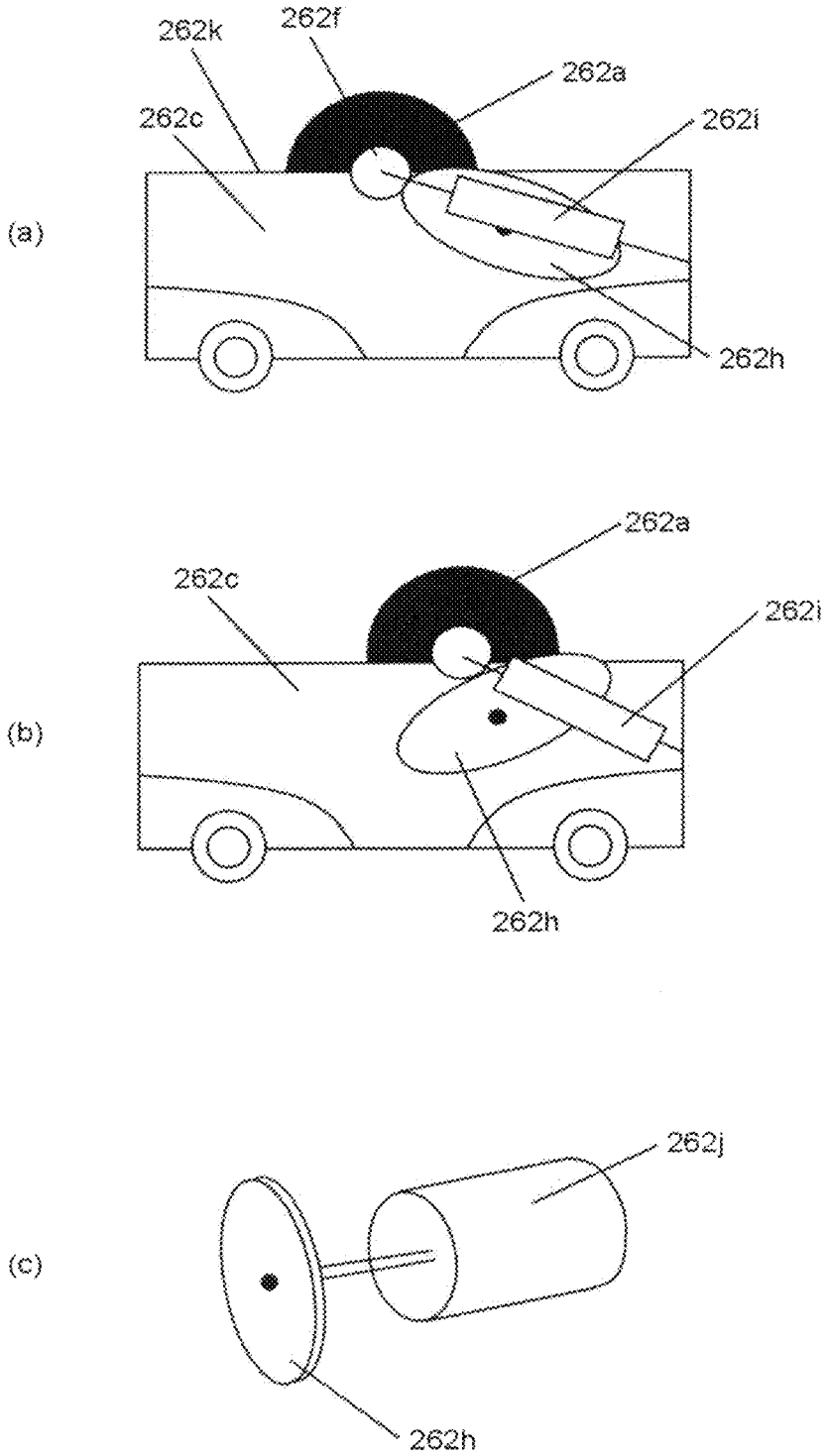
FIGS. 31(*a*) to 31(*c*) are diagrams schematically illustrating an example in which the lower additional-folding roller is moved by using a cam.

FIGS. 30(*a*) to 30(*d*) illustrate an example in which the user directly operates the device. Alternatively, the bearing position can be mechanically changed. FIGS. 31(*a*) to 31(*c*) are diagrams schematically illustrating an example in which the position of the lower additional-folding roller 262*a* is changed by using a cam.

In this example, a shaft position is moved by an eccentric cam 262*h* using the rotation axes 262*f* of the lower additional-folding roller 262*a* as a cam follower. Specifically, as illustrated in FIGS. 31(*a*) to 31(*c*), the rotation axes 262*f* is pressed against a cam surface of the eccentric cam 262*h* with a tension spring 2621, and the shaft position is restricted. The eccentric cam 262*h* is rotatably driven by a motor 262*j* as illustrated in FIG. 31C. The lower additional-folding roller 262*a* linearly reciprocates along a guide surface 262*k* of the lower additional-folding roller case 262*c* corresponding to a rotational position of the eccentric cam 262*h*. Accordingly, it is possible to arbitrarily change a relative position of the lower additional-folding roller 262*a* with respect to the upper additional-folding roller 261*a* in a range in which the lower additional-folding roller 262*a* can reciprocate.

That is, the additional-folding strength is increased when the position of the lower additional-folding roller 262*a* is shifted to the outside (the downstream side or the upstream side of the additional-folding direction). To increase the additional-folding strength, the eccentric cam 262*h* is rotated from the position of FIG. 31(*a*) to move the lower additional-folding roller 262*a* to the position of FIG. 31(*b*). Accordingly, the straight line Y' connecting the center axes 261*b*1 and 262*f*1 of the pair of additional-folding rollers 261*a* and 262*a* is inclined (angle θ is changed) with respect to the straight line Y (thickness direction t of the center-folded sheet bundle SB), and the additional-folding strength can be increased. In this case, the angle θ can be set to an arbitrary angle by controlling a rotation angle of the eccentric cam 262*h*, and an arbitrary additional-folding strength can be obtained due to this angle setting. Among FIGS. 31(*a*) to 31(*c*), FIG. 31(*a*) corresponds to the position of FIG. 24, and FIG. 31(*b*) corresponds to the position of FIG. 25.

Figure 32:
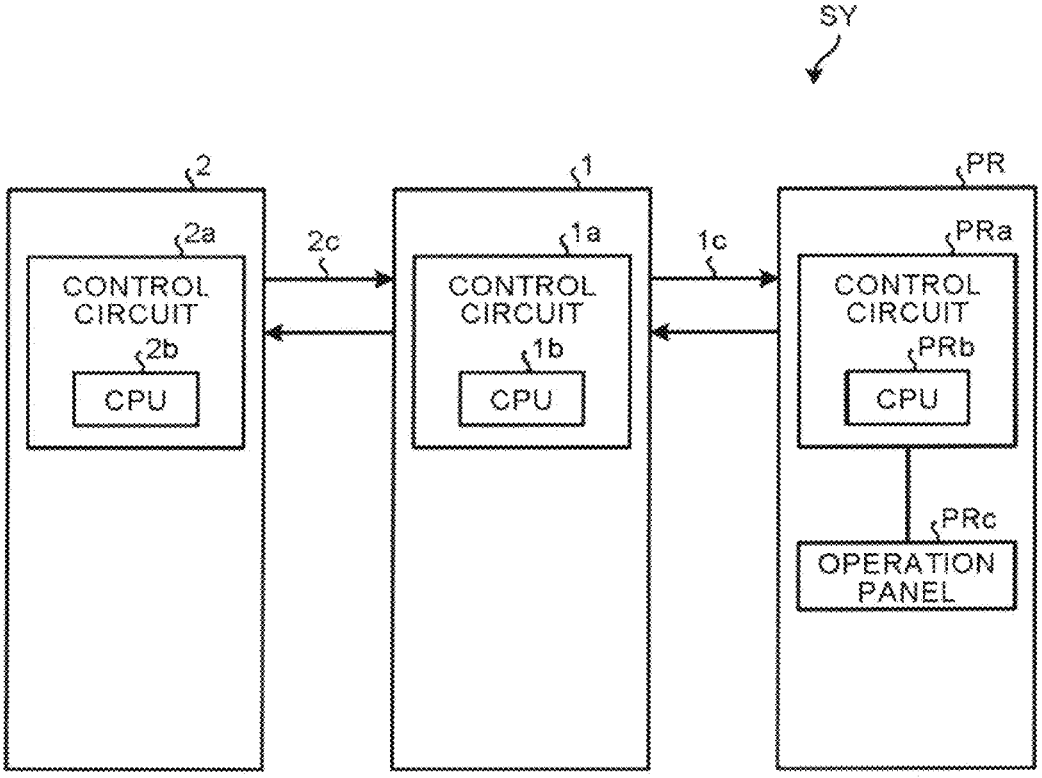
FIG. 32 is a block diagram illustrating a control configuration of an image forming system SY according to the embodiment.

FIG. 32 is a block diagram illustrating a control configuration of an image forming system SY according to the embodiment.

In FIG. 32, an image forming apparatus PR, a first sheet postprocessing device 1, and a saddle-stitch bookbinding device 2 include control circuits PRa, 1*a*, and 2*a* including CPUs PRb, 1*b*, and 2*b* and a microcomputer that includes a random access memory (RAM), a read only memory (ROM), an I/O interface, and the like mounted thereon, respectively. Signals from the CPU_PRb or each switch of an operation panel PRc of the image forming apparatus PR and from each sheet detecting sensor (not illustrated) are input to the CPU 1*b* of the first sheet postprocessing device 1 via a communication interface ic. Similarly, a signal from the CPU 1*b* of the first sheet postprocessing device 1 or a signal from the image forming apparatus PR are input to the CPU 2*b* of the saddle-stitch bookbinding device 2 via a communication interface 2*c*.

The motor 262*j* is controlled, for example, by the CPU 2*b* of the control circuit 2*a* mounted on the saddle-stitch bookbinding device 2 based on an operation input from a operation panel PRc arranged on the image forming apparatus PR side. The CPU 2*b* includes a control unit and an arithmetic unit. The control unit controls interpretation of a command and a control procedure of a computer program, and the arithmetic unit executes an arithmetic operation. The computer program is stored in a memory (not illustrated), a command to be executed (a certain numerical value or a list of numerical values) is taken out from the memory in which the computer program is stored, and the computer program is executed.

Alternatively, a solenoid can be used instead of the eccentric cam 262*h* and the motor 262*j*. However, when the solenoid is used, only two positions corresponding to the positions of FIG. 24 and FIG. 25 can be employed similarly to the case illustrated in FIGS. 30(*a*) to 30(*d*).

The following describes a control procedure and an operation of additional-folding according to the embodiment using examples.

First example

Figure 33:
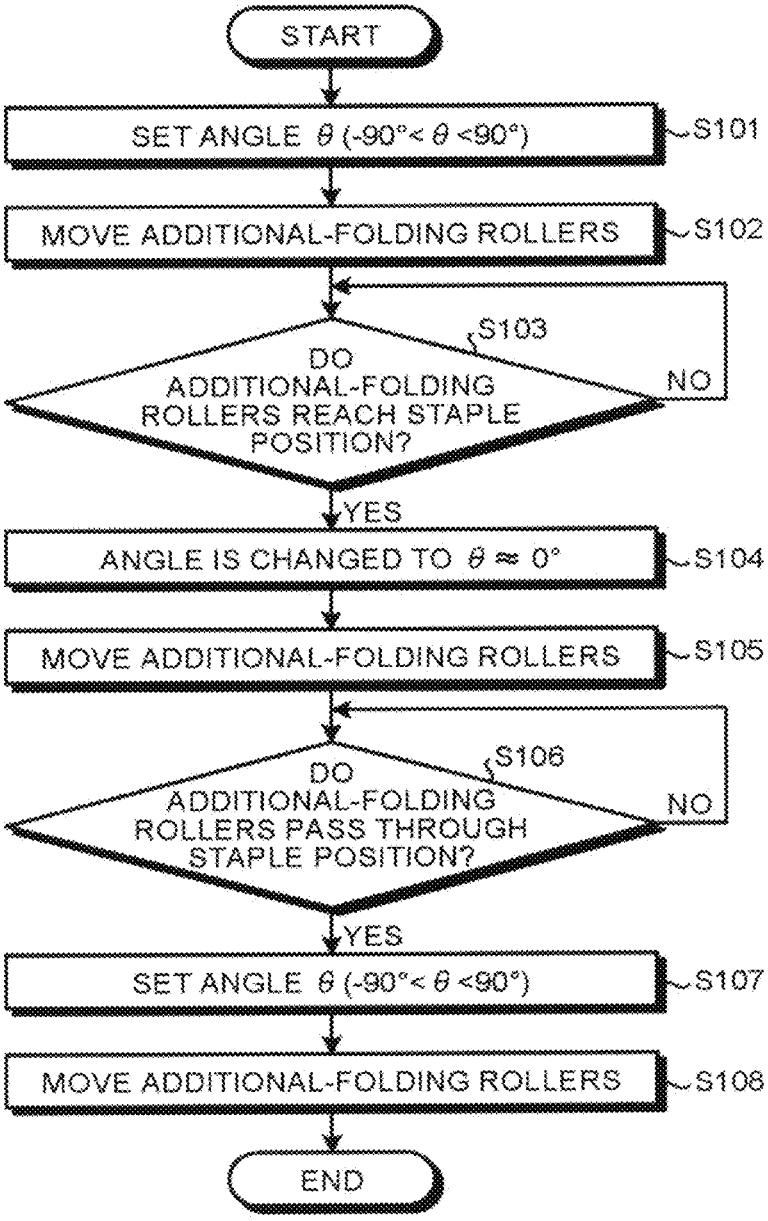
FIG. 33 is a flowchart illustrating a control procedure of additional-folding in a first example.
Figure 34:
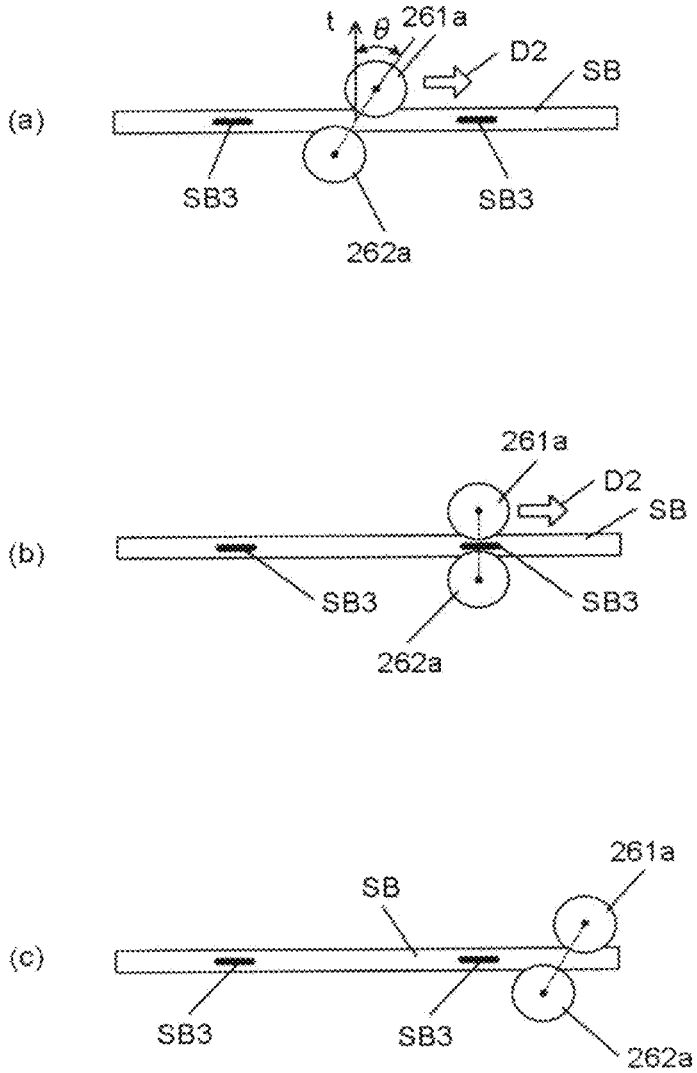
FIGS. 34(*a*) to 34(*c*) are operation explanatory diagrams illustrating an additional-folding operation in the first example.

FIG. 33 is a flowchart illustrating a control procedure of additional-folding in a first example, and FIGS. 34(*a*) to 34(*c*) are operation explanatory diagrams illustrating an additional-folding operation in the first example. In the first example, additional folding is performed such that the angle θ is set to θ≈0° at a staple position, the angle θ being formed by the straight line Y' connecting the center axes 261*b*1 and 262*f*1 of the pair of additional-folding rollers 261*a* and 262*a* and a fold direction of the center-folded sheet bundle (FIG. 25: X-direction).

In the control procedure of FIG. 33, the angle θ is set to an arbitrary angle in a range of −90°<θ<90° (Step S101: hereinafter, Step S is simply referred to as "S"), and the pair of additional-folding rollers 261*a* and 262*a* is moved in a direction of the arrow D2 (S102: FIG. 34(*a*)). If the pair of additional-folding rollers 261*a* and 262*a* reaches the staple SB3 position (Yes at S103), the angle θ is changed to θ≈0 (5104: FIG. 34(*b*)), and the pair of additional-folding rollers 261*a* and 262*a* is moved in the direction of the arrow D2 until passing through the staple SB3 position (S105).

If the pair of additional-folding rollers 261*a* and 262*a* passes through the staple SB3 position (5106), the angle θ is set to an arbitrary angle in a range of −90°<θ<90° (for example, returned to the original angle θ) (S107). Subsequently, the pair of additional-folding rollers 261*a* and 262*a* is further moved in the direction of the arrow D2 (S108: FIG. 34(*c*)). The pair of additional-folding rollers 261*a* and 262*a* is simply referred to as an additional-folding rollers in the drawing.

In the first example, the angle θ is changed during the additional-folding operation, and the angle θ is set to θ≈0° at the position of the staple SB3. Due to this, the staple SB3 is prevented from being bent, and additional-folding can be performed at an arbitrary angle θ other than θ≈0 at the other positions. Accordingly, the fold line part SB1 of the center-folded sheet bundle SB can be optimally reinforced.

Second example

Figure 35:
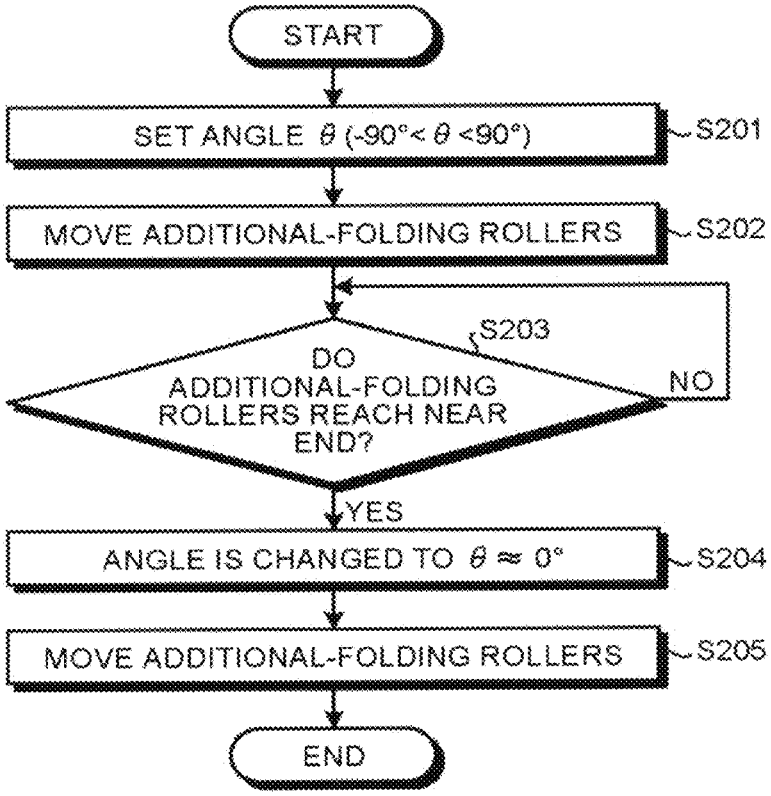
FIG. 35 is a flowchart illustrating a control procedure of additional-folding in a second example.
Figure 36:
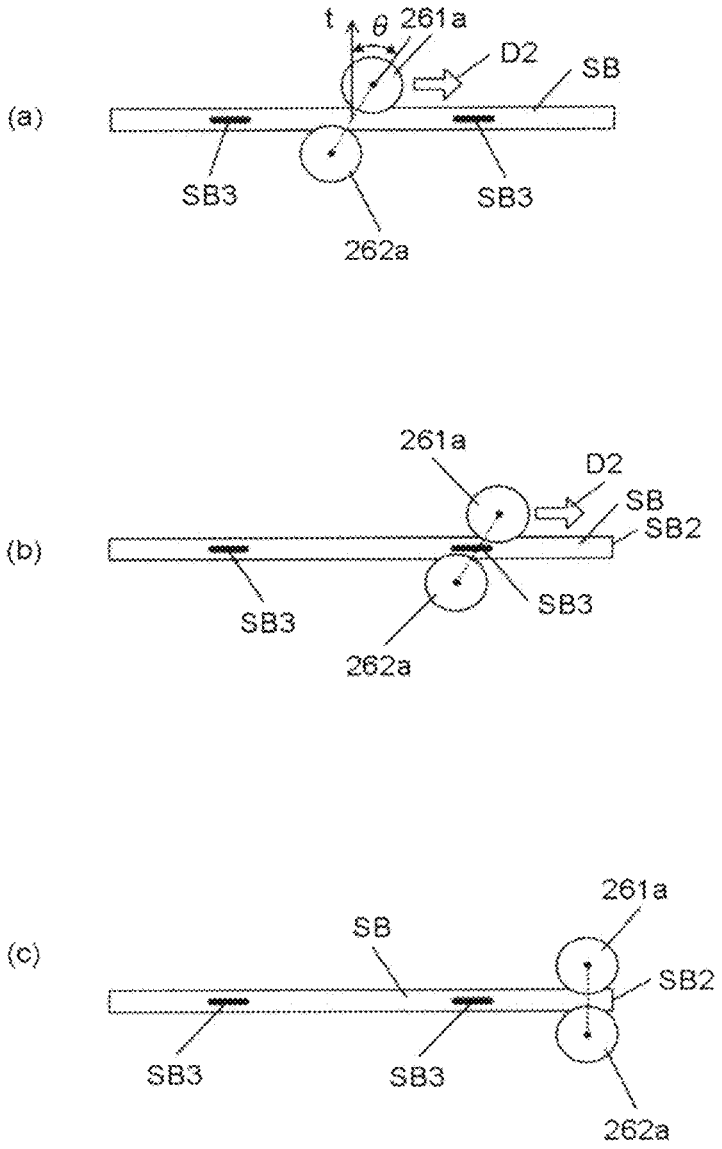
FIGS. 36(*a*) to 36(*c*) are operation explanatory diagrams illustrating an additional-folding operation in the second example.

FIG. 35 is a flowchart illustrating a control procedure of additional-folding in a second example, and FIGS. 36(*a*) to 36(*c*) are operation explanatory diagrams illustrating an additional-folding operation in the second example. In the second example, additional folding is performed such that the angle θ is set to θ≈0° at an end SB2 of the center-folded sheet bundle, and the angle θ is set to an arbitrary angle in a range of −90°<θ<90° at the position of the staple SB3, the angle θ being formed by the straight line Y' connecting the center axes 261*b*1 and 262*f*1 of the pair of additional-folding rollers 261*a* and 262*a* and the thickness direction t of the center-folded sheet bundle SB.

In the control procedure of FIG. 35, the angle θ of the pair of additional-folding rollers 261*a* and 262*a* is set to an arbitrary angle in a range of −90°θ0<90° to start additional-folding (S201: FIG. 36(*a*)). The pair of additional-folding rollers 261*a* and 262*a* is moved in the direction of the arrow D2 while keeping the angle θ (S202: FIG. 36(*b*)). If the pair of additional-folding rollers 261*a* and 262*a* reaches near the end SB2 of the center-folded sheet bundle SB (Yes at S203), the angle θ is changed to θ≈0° (S204: FIG. 36(*c*)). Subsequently, the pair of additional-folding rollers 261*a* and 262*a* is further moved in the direction of the arrow D2 (S205: FIG. 36(*c*)).

In the second example, the angle θ is changed during the additional-folding operation, and the angle θ is set to θ≈0° near the end SB2 of the sheet bundle SB. Due to this, the end SB2 of the center-folded sheet bundle SB is prevented from drooping. At positions other than the end SB2 or other than near the end SB2, additional-folding can be performed at an arbitrary angle θ in a range of −90°<θ<90°, so that the fold line part SB1 of the center-folded sheet bundle SB can be optimally reinforced.

Third example

Figure 37:
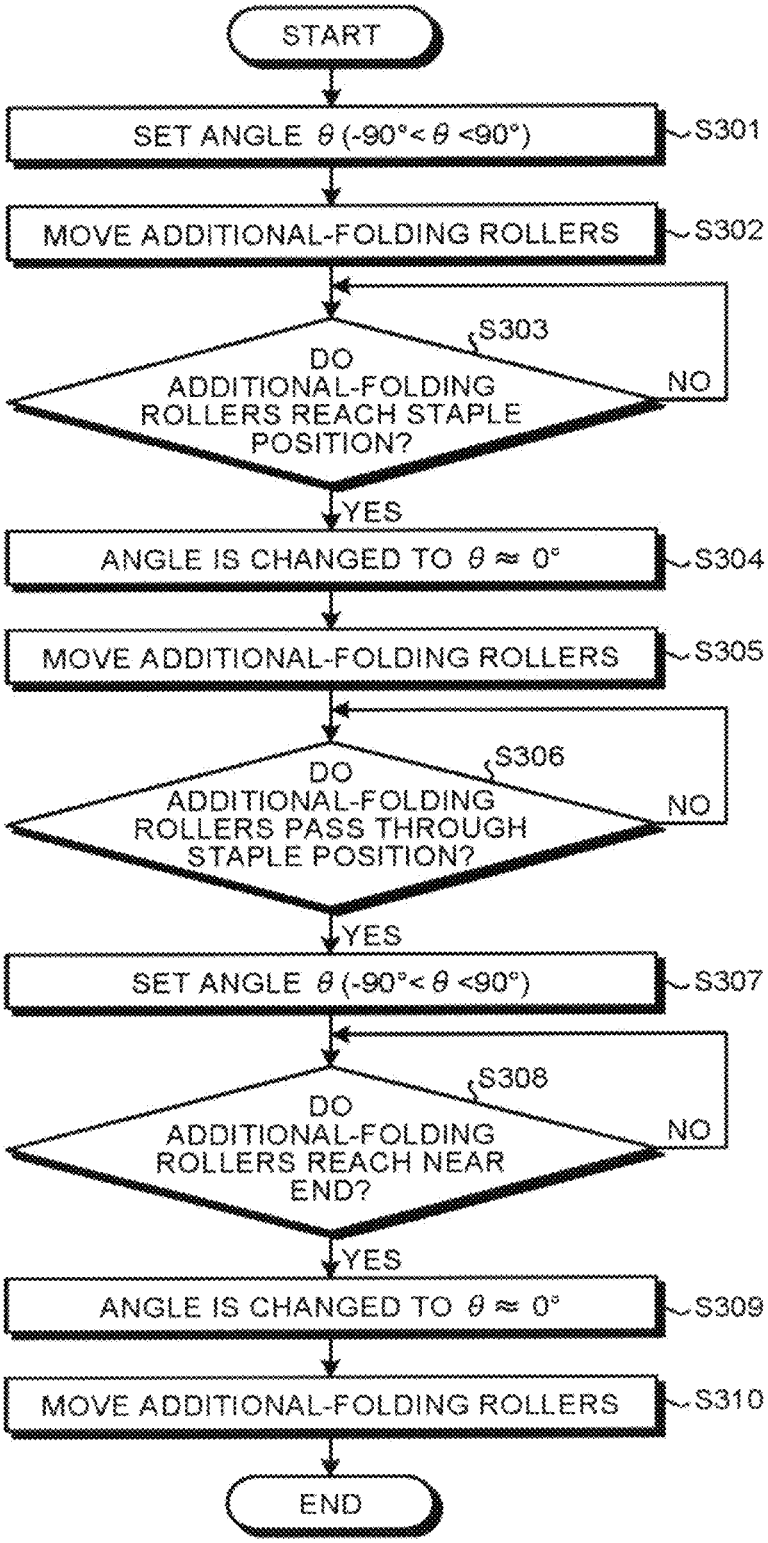
FIG. 37 is a flowchart illustrating a control procedure of additional-folding in a third example.
Figure 38:
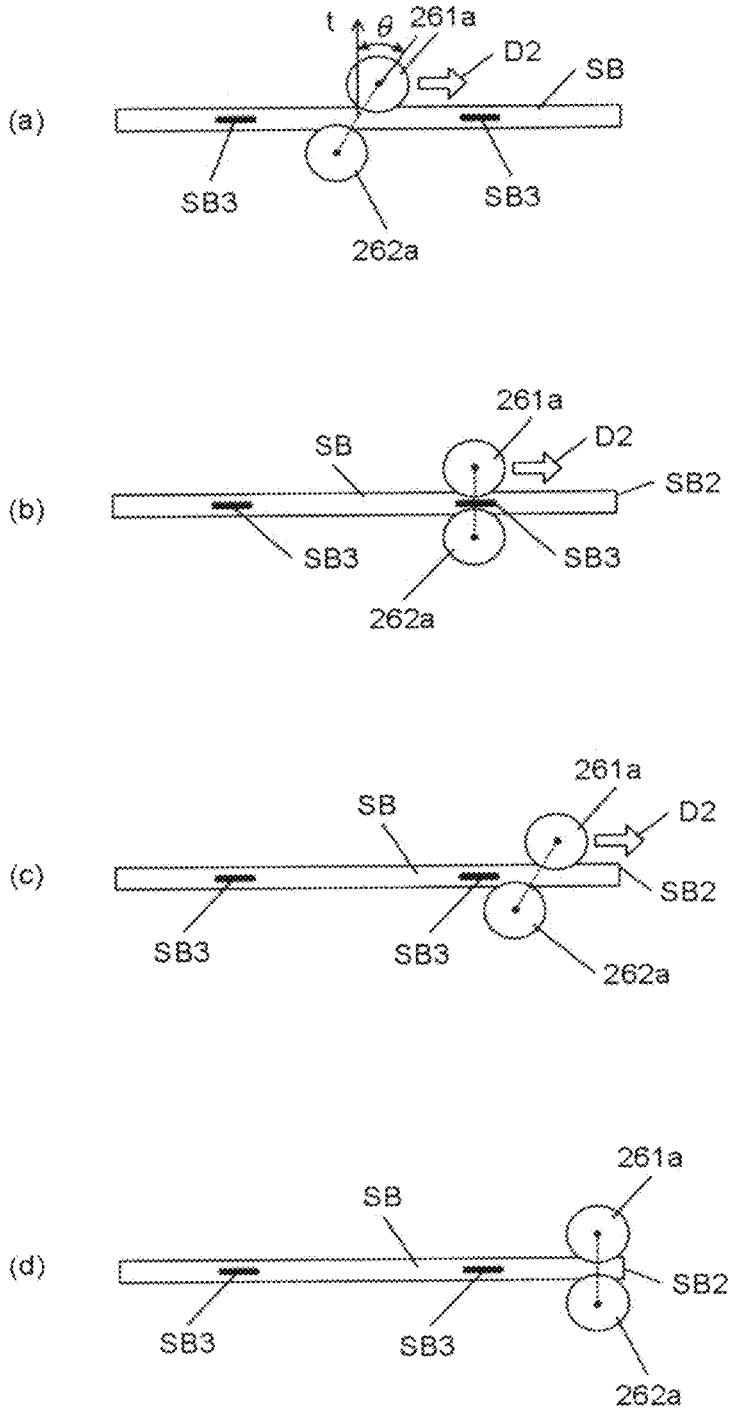
FIGS. 38(*a*) to 38(*d*) are operation explanatory diagrams illustrating an additional-folding operation in the third example.

FIG. 37 is a flowchart illustrating a control procedure of additional-folding in a third example, and FIGS. 38(*a*) to 38(*d*) are operation explanatory diagrams illustrating an additional-folding operation in the third example. In the third example, the angle θ is set to θ≈0° at the position stitched with the staple SB3 and the end SB2 of the center-folded sheet bundle SB, and the angle θ is set to an arbitrary angle in a range of −90°<θ<90° at the other positions to perform additional-folding.

In the control procedure of FIG. 37, the angle θ of the pair of additional-folding rollers 261*a* and 262*a* is set to an arbitrary angle in a range of −90°<θ<90° to start additional-folding (S301), and the pair of additional-folding rollers 261*a* and 262*a* is moved in the direction of the arrow D2 (S302: FIG. 38(*a*)). If the pair of additional-folding rollers 261*a* and 262*a* reaches the staple SB3 position (Yes at S303), the angle θ is changed to θ≈0 (S304: FIG. 38(*b*)), and the pair of additional-folding rollers 261*a* and 262*a* is moved in the direction of the arrow D2 until passing through the staple SB3 position (S305).

If the pair of additional-folding rollers 261*a* and 262*a* passes through the staple SB3 position (S306), the angle θ is set to an arbitrary angle in a range of −90°<θ<90° (returned to the original angle θ) (S307). Subsequently, the pair of additional-folding rollers 261*a* and 262*a* is further moved in the direction of the arrow D2 (S308: FIG. 38(*c*)). If the pair of additional-folding rollers 261*a* and 262*a* reaches near the end SB2 of the center-folded sheet bundle SB (Yes at S308), the angle θ is changed to θ≈0° (S309: FIG. 38(*d*)). The pair of additional-folding rollers 261*a* and 262*a* is moved until passing through the end SB2 while keeping this state (S310).

In the third example, the angle θ is changed during the additional-folding operation, and the angle θ is set to θ≈0° at the position of the staple SB3. Due to this, the staple SB3 is prevented from being bent, and additional-folding can be performed at the angle θ at the other positions. The angle θ is changed during the additional-folding operation, and the angle θ is set to θ≈0° near the end SB2 of the sheet bundle SB. Due to this, the end SB2 of the sheet bundle SB is prevented from drooping. In addition, at positions other than the position of the staple SB or other than near the end SB2, additional-folding can be performed at an arbitrary angle θ in a range of −90°<θ<90°, so that the fold line part SB1 of the center-folded sheet bundle SB can be optimally reinforced.

Fourth example

Figure 39:
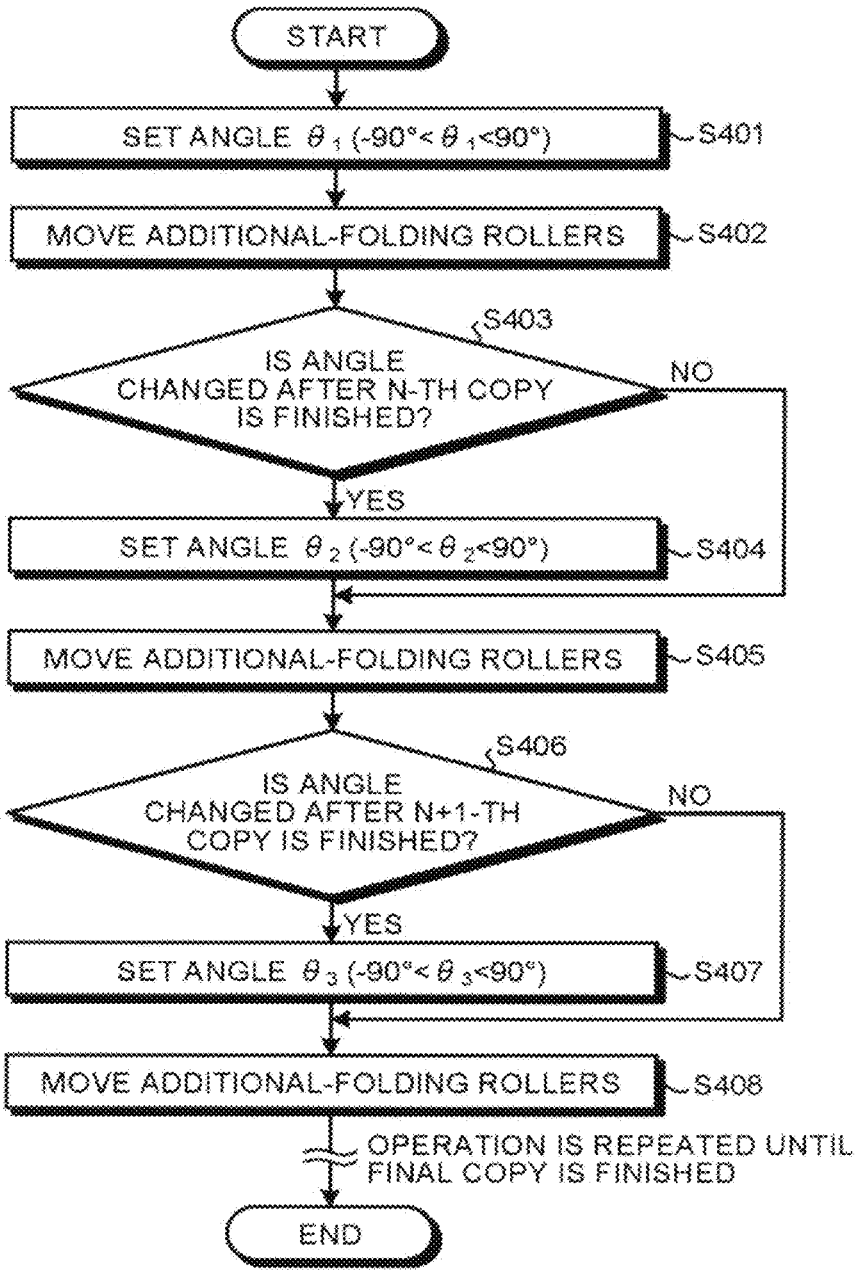
FIG. 39 is a flowchart illustrating a control procedure of additional-folding in a fourth example.
Figure 41:
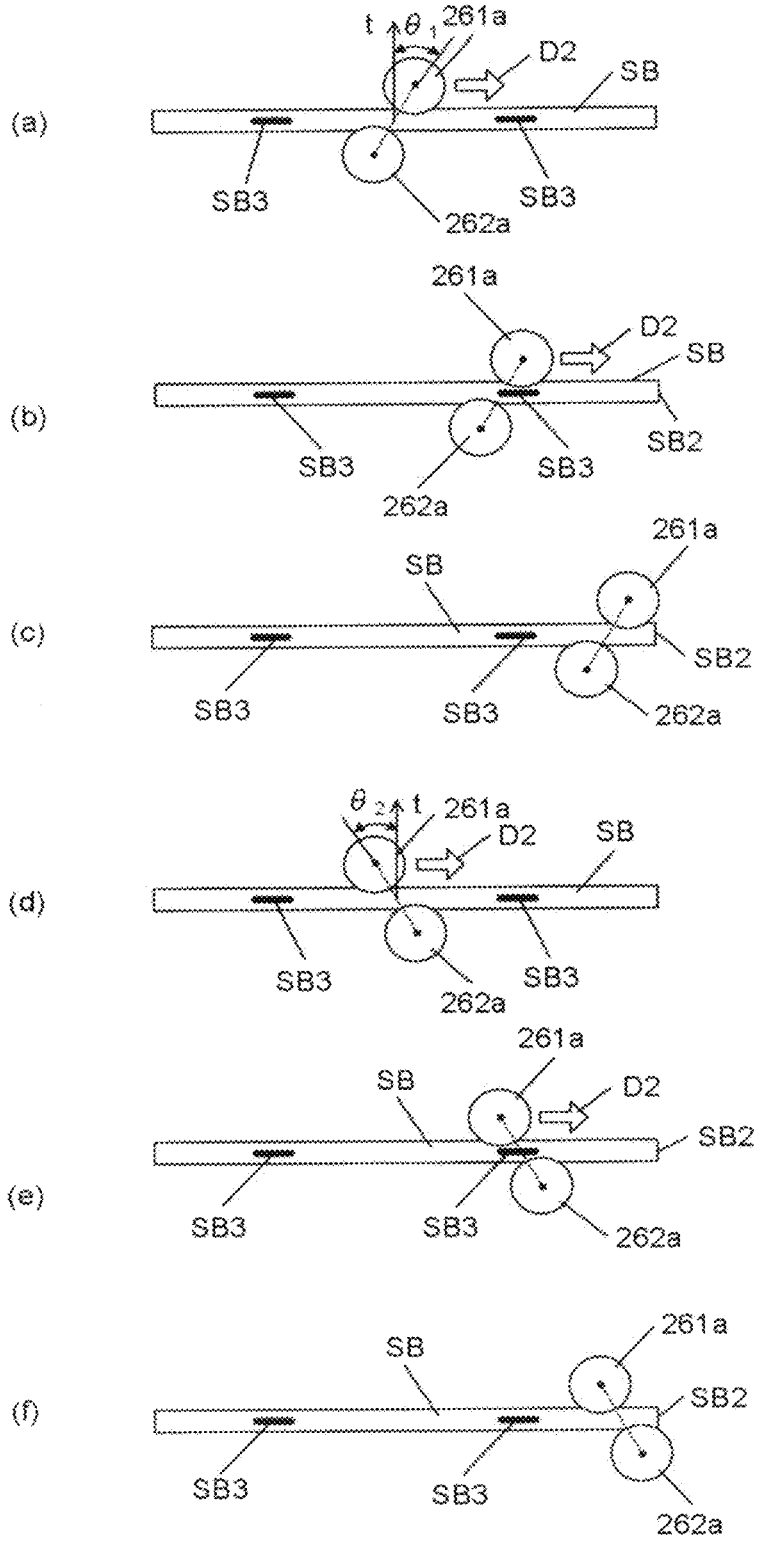
FIGS. 41(*a*) to 41(*f*) are operation explanatory diagrams illustrating an additional-folding operation in the fourth and a fifth examples.

FIG. 39 is a flowchart illustrating a control procedure of additional-folding in a fourth example, and FIGS. 41(*a*) to 41(*f*) are operation explanatory diagrams illustrating an additional-folding operation in the fourth example. In the fourth example, the angle θ is changed for each copy to perform additional-folding.

In the control procedure of FIG. 39, the angle θ of the pair of additional-folding rollers 261*a* and 262*a* is set to an arbitrary angle θ1 in a range of −90°<θ1<90° to start additional-folding on the center-folded sheet bundle SB as the N-th copy (S401). Subsequently, the pair of additional-folding rollers 261*a* and 262*a* is moved in the direction of the arrow D2 (S402: FIG. 41A). In the fourth example, even when the pair of additional-folding rollers 261*a* and 262*a* reaches the staple SB3 position, additional-folding is performed while keeping the angle θ1 (FIG. 41(*b*)), and the pair of additional-folding rollers 261*a* and 262*a* is moved until passing through the staple SB3 position (FIG. 41(*c*)) and further passing through the end SB2 of the center-folded sheet bundle SB while keeping the angle θ1. The pair of additional-folding rollers 261*a* and 262*a* then returns in a reverse direction (a direction of the arrow D3), starts to press the center-folded sheet bundle SB as described above near the center part of the center-folded sheet bundle SB, and finishes the additional-folding on the center-folded sheet bundle SB as the N-th copy.

Subsequently, it is determined whether or not to change the angle θ from θ1 to θ2 after the additional-folding of the N-th copy is finished. If the angle θ is changed (Yes at S403), the angle θ is set to an arbitrary angle θ2 in a range of −90°<θ2<90° that is different from θ1 (S404). From the N+1-th copy, the angle θ is set to the angle θ2, the additional-folding is started from near the center part of the sheet bundle SB, and the pair of additional-folding rollers 261*a* and 262*a* is moved in the direction of the arrow D2 (S405: FIG. 41(*d*)). In FIGS. 41(*a*) to 41(*f*), although the angle θ2 is illustrated as an obtuse angle assuming that the angle θ1 is an acute angle, the angle θ2 may be any angle that is different from the angle θ1. FIGS. 41(*a*) to 41(*f*) are exemplary only, for explanation purpose.

In the case of the N+1-th copy, similarly to the case of the N-th copy, the pair of additional-folding rollers 261*a* and 262*a* performs additional-folding to the end SB2 of the center-folded sheet bundle SB at the angle θ2 (FIGS. 41(*e*) and 41(*f*)), returns to near the center part and performs additional folding while moving in the direction of the arrow D3 as a backward route, and returns to the initial position. In this case, it is determined whether or not to change the angle θ from θ2 to θ3 after the additional-folding of the N+1-th copy is finished. If the angle θ is changed (Yes at S406), the angle θ is set to an arbitrary angle θ3 in a range of −90°<θ3<90° that is different from θ2 (S407). From the N+1-th copy, the angle θ is set to the angle θ3, the additional-folding is started from near the center part of the center-folded sheet bundle SB, and the pair of additional-folding rollers 261*a* and 262*a* is moved in the direction of the arrow D2 (S404). The angle θ3 may be any angle that is different from the angle θ2.

This operation will be repeated until the job is finished. If the angle θ is not changed at S403 and S406, the process proceeds to S405 and S408 while skipping S404 and S407, respectively, and additional-folding is performed at the same angle θ.

When the additional-folding is performed at the angle θ as described above, the center-folded sheet bundle SB is bent and the stacking property is deteriorated depending on a type and a thickness of the sheet, the number of sheets to be stitched, and the like. However, when the angle θ is changed for each copy as in the fourth example, bending of the center-folded sheet bundle SB is prevented from being accumulated, so that the stacking property of the center-folded sheet bundle SB is improved.

Fifth example

Figure 40:
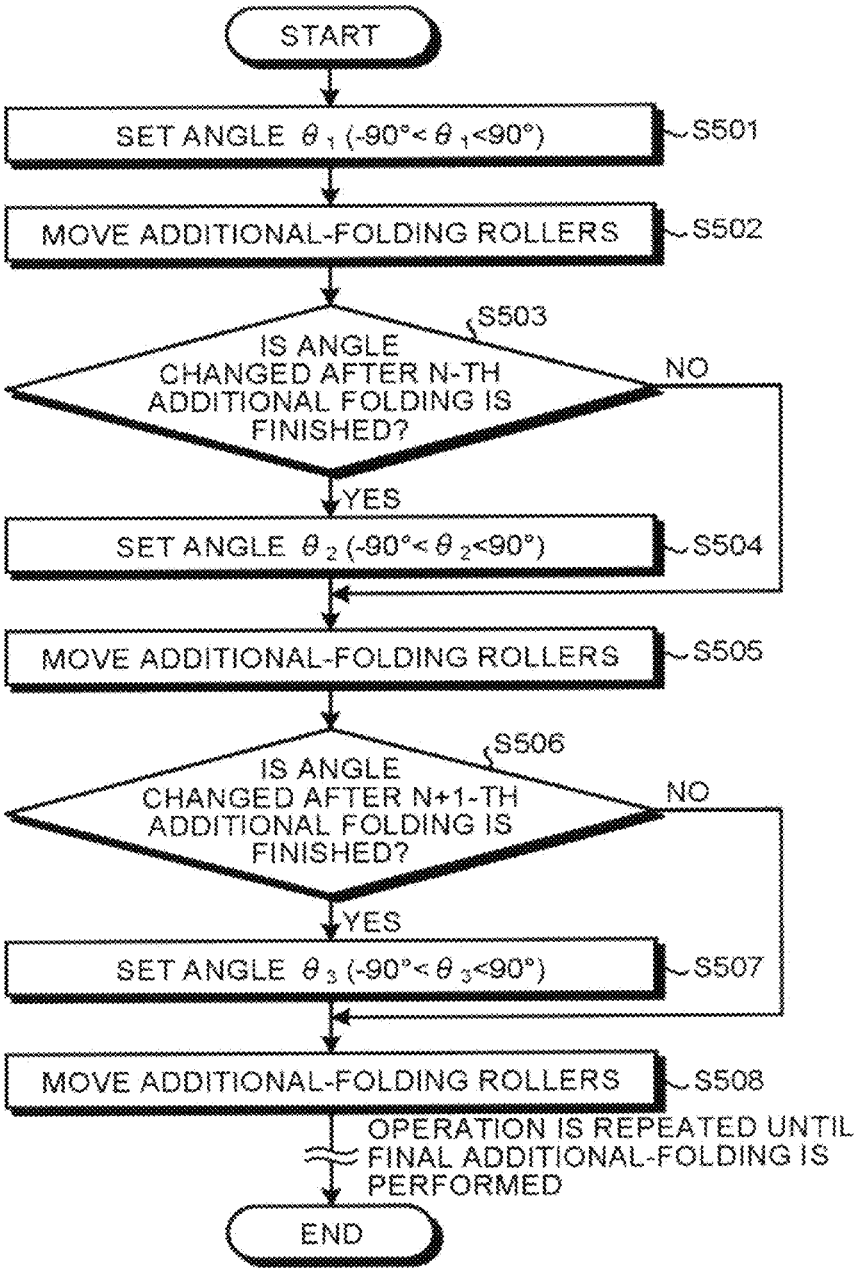
FIG. 40 is a flowchart illustrating a control procedure of additional-folding in the fourth example.

FIG. 40 is a flowchart illustrating a control procedure of additional-folding in a fifth example, and FIGS. 41(*a*) to 41(*f*) are operation explanatory diagrams illustrating an additional-folding operation in the fifth example. In the fifth example, additional-folding is performed by changing the angle θ depending on the number of times of additional-folding. The operation itself of the fifth example is the same as that of the fourth example.

The flowchart of FIG. 40 is the same as that of FIG. 39 except that determination processing for changing the angle after the additional-folding of the N-th copy is finished at S403 in the flowchart of FIG. 39 is changed to determination processing for changing the angle after the N-th additional-folding is finished at S503, and determination processing for changing the angle after the additional-folding of the N+1-th copy is finished at S406 is changed to determination processing for changing the angle after the N+1-th additional-folding is finished at 5506. The operation thereof is the same as that of the fourth example.

When the additional-folding is performed at the angle θ as described above, the center-folded sheet bundle SB is bent and the stacking property is deteriorated depending on a type and a thickness of the sheet, the number of sheets to be stitched, and the like. However, when the angle θ is changed depending on the number of times of additional-folding as in the fifth example, bending of the center-folded sheet bundle SB is prevented from being accumulated similarly to the fourth example, so that the stacking property of the sheet bundle SB is improved.

Figure 42:
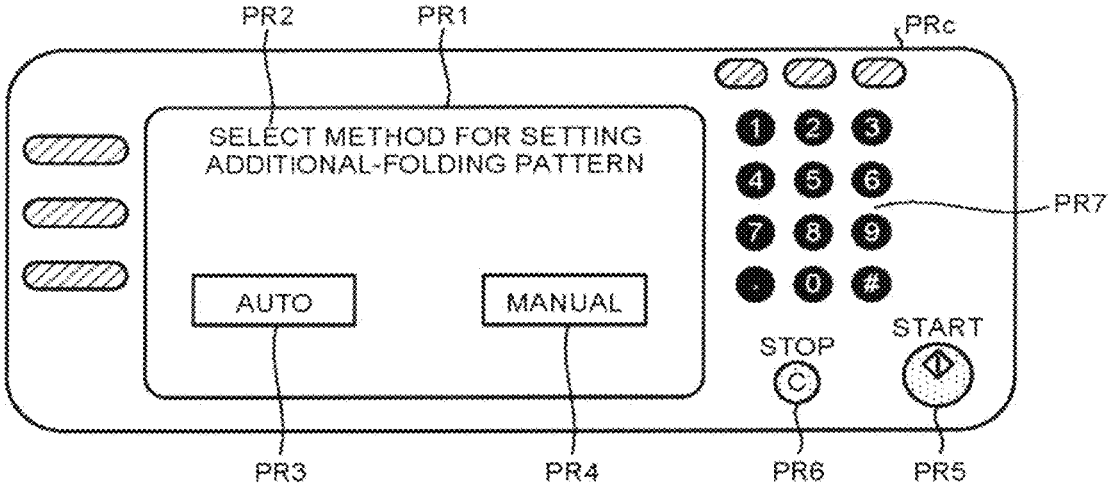
FIG. 42 is a diagram illustrating a setting screen of additional-folding pattern according to the embodiment of the present invention.

FIG. 42 is a diagram illustrating a setting screen of additional-folding pattern according to the embodiment.

The operation panel PRc includes an operation display screen PR1, and hard keys such as a start key PR5, a stop key PR6, and a numeric keypad PR7 arranged thereon. The operation display screen PR1 is a touch panel and includes soft keys such as a message display part PR2, an "auto" select button PR3, and a "manual" select button PR4 arranged thereon. A hierarchy of the soft keys is switched depending on a selected function, and other function keys are also displayed.

In the first to fifth examples, the angle 8 is changed at a predetermined portion or is not changed to perform additional-folding as described above. The user can input and set the angle θ, whether to change the angle, and the like via the hard keys (numeric keypad PR7) on the operation panel PRc of the image forming apparatus PR and the soft keys (the auto select button PR3 and the manual select button PR4) on the operation display screen PR1.

When the "auto" select button PR3 is operated on the operation display screen PR1 to select auto, additional-folding is performed by controlling the angle θ according to an angle change pattern prepared in advance and booklet information such as sheet information, a stitching position, and the number of sheets to be stitched. The sheet information means information such as a thickness of the sheet, a type of the sheet, and a size of the sheet.

When the "manual" select button PR4 is operated to select manual, the operation display screen PR1 is switched to display function keys to be selected by the user for setting the additional-folding pattern (the angle θ at each position such as the center part, the staple position, and the end of the sheet bundle SB). The user can arbitrarily set the position and the angle θ by operating the function keys and inputting a numerical value via the numeric keypad PR7.

As described above, the following effects can be obtained according to the embodiment.

(1) The saddle-stitch bookbinding device 2 (sheet processing device) includes the pair of additional-folding rollers 261*a* and 262*a* (pressing unit) for pressing the fold line part SB1 of the folded sheet bundle SB and the unit moving mechanism 263 (moving unit) for moving a pressing position of the pair of additional-folding rollers 261*a* and 262*a* (pressing unit) in the fold direction of the folded sheet bundle SB. The pair of additional-folding rollers 261*a* and 262*a* (pressing unit) is a pair of pressing rollers holding the folded sheet bundle SB therebetween. The pair of additional-folding rollers 261*a* and 262*a* (pressing rollers) changes the angle θ between the thickness direction t of the folded sheet bundle SB and the line Y' connecting the center axes 261*b*1 and 262*f*1 (rotational centers) of the pair of additional-folding rollers 261*a* and 262*a* in the middle of the movement, so that it is possible to prevent the deformation of the staple or the drooping of the end of the folded sheet bundle when the additional-folding is performed at a constant angle θ, and prevent the stacking property of the folded sheet bundle from being impaired.

That is, in additional-folding of the fold line part SB1 of the saddle-stitched sheet bundle SB, the fold is reinforced by the pair of additional-folding rollers 261*a* and 262*a* moving along the fold direction. In this case, by shifting the angle θ from 0 degree between the thickness direction t of the folded sheet bundle SB and the line Y' connecting the center axes 261*b*1 and 262*f*1 of the pair of additional-folding rollers 261*a* and 262*a*, a crease is made such that the fold line part SB1 is bent, not only pressed. Due to this crease, the fold is further reinforced.

The additional-folding strength is increased as a shift amount is increased. However, in this case, the staple SB3 is deformed and the drooping is caused, so that the stacking property is impaired. Accordingly, for example, when the angle θ is set to 0° at the position of the staple SB or the end SB2 of the sheet bundle SB, the additional-folding is performed without bending, so that the folded sheet bundle SB is not bent at the corresponding portion. Due to this, the stacking property of the folded sheet bundle SB is prevented from being impaired.

(2) The angle θ of the pair of additional-folding rollers 261*a* and 262*a* (pressing unit) is set to θ≈0 at the stitching position of the folded sheet bundle SB, and the angle θ is set to 0≤θ<90° at positions other than the stitching position. The unit moving mechanism 263 (moving unit) moves the pair of additional-folding rollers 261*a* and 262*a* at the angle θ as described above, so that the folding quality of the sheet bundle SB can be secured while preventing the staple SB3 from being bent.

(3) The angle θ of the pair of additional-folding rollers 261*a* and 262*a* (pressing unit) is set to θ≈0 at the end SB2 of the folded sheet bundle SB, and the angle θ is set to 0≤θ<90° at positions other than the end SB2 or other than near the end SB2. The unit moving mechanism 263 (moving unit) moves the pair of additional-folding rollers 261*a* and 262*a* at the angle as described above, so that the folding quality of the folded sheet bundle SB can be secured while preventing the end SB2 of the folded sheet bundle SB from drooping.

(4) The angle θ of the pair of additional-folding rollers 261*a* and 262*a* (pressing unit) is changed for each copy, and the unit moving mechanism 263 (moving unit) moves the pair of additional-folding rollers 261*a* and 262*a* of which angle θ is changed, so that a bending degree is changed for each copy and the bending of the folded sheet bundle SB is prevented from being accumulated in stacking. Accordingly, the stacking property of the folded sheet bundle SB is prevented from being impaired.

(5) The angle θ of the pair of additional-folding rollers 261*a* and 262*a* (pressing unit) is changed depending on the number of times of pressing, and the unit moving mechanism 263 (moving unit) moves the pair of additional-folding rollers 261*a* and 262*a* of which angle θ is changed, so that the bending degree is changed for each copy and the bending of the folded sheet bundle SB is prevented from being accumulated in stacking. Accordingly, the stacking property of the folded sheet bundle SB is prevented from being impaired.

(6) A change pattern of the angle θ is set based on the pattern set in advance, so that the angle θ is automatically set to an optimal value in additional-folding. Accordingly, the stacking property of the folded sheet bundle SB is prevented from being impaired.

(7) The angle θ is changed based on the booklet information including one of the sheet information, the stitching position, and the number of sheets to be stitched, so that the angle θ is automatically set to an optimal value based on the booklet information to perform additional-folding. Accordingly, the stacking property of the folded sheet bundle SB is prevented from being impaired.

(8) The user can set the angle θ, so that additional-folding can be performed corresponding to an intention of the user.

(9) An image forming system is provided that includes the image forming apparatus PR and the sheet processing device having the effects described in (1) to (8), so that the image forming system can exhibit the effects of (1) to (8).

(10) Provided is a method of additionally folding the folded sheet bundle SB in the saddle-stitch bookbinding device 2 (sheet processing device) including the pair of additional-folding rollers 261*a* and 262*a* (pressing unit) for pressing the fold line part SB1 of the folded sheet bundle SB and the unit moving mechanism 263 (moving unit) for moving the pressing position of the pair of additional-folding rollers 261*a* and 262*a* (pressing unit) in the fold direction of the folded sheet bundle SB. In an additional-folding process for additionally folding the fold line part SB of the folded sheet bundle SB with the pressing unit including the pair of additional-folding rollers 261*a* and 262*a* (pressing rollers) that holds the sheet bundle SB therebetween, the angle θ is changed between the thickness direction t of the folded sheet bundle SB and the line Y' connecting the center axes 261*b*1 and 262*f*1 (rotational centers) of the pair of additional-folding rollers 261*a* and 262*a*, so that it is possible to prevent the deformation of the staple or the drooping of the end of the folded sheet bundle when the additional-folding is performed at a constant angle θ, and prevent the stacking property of the folded sheet bundle from being impaired.

In the description of the effects of the embodiment, each component to be described in the scope of claims corresponding to each unit in the embodiment is put in brackets, or denoted by a reference numeral, to clarify the correspondence relation therebetween.

The present invention prevents the deformation of the staple or the drooping of the end of the sheet bundle in additional-folding, and prevents the stacking property of the sheet bundle from being impaired.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a pressing unit that presses a fold line part of a folded sheet bundle; and a moving unit that moves a pressing position of the pressing unit in a fold direction of the folded sheet bundle, wherein the pressing unit includes a pair of pressing rollers that holds the folded sheet bundle therebetween, the pair of pressing rollers changes an angle θ between a thickness direction of the folded sheet bundle and a line connecting rotational centers of the pressing rollers in a middle of movement, and the rotational center of a first roller of the pair rollers is fixed relative to the moving unit and the rotational center of a second roller of the pair of rollers is moveable in the fold direction relative to the moving unit.

2. The sheet processing device according to claim 1, wherein the angle θ of the pressing unit is set to θ≈0 at a stitching position of the folded sheet bundle, and the angle θ is set to an arbitrary angle in a range of $-90° < \theta < 90°$ at positions other than the stitching position, and the moving unit moves the pressing unit at the angle θ as described above.

3. The sheet processing device according to claim 1, wherein the angle θ of the pressing unit is set to $\theta < 0$ at an end of the folded sheet bundle, and the angle θ is set to an arbitrary angle in a range of $-90° < \theta < 90°$ at positions other than the end, and the moving unit moves the pressing unit at the angle θ as described above.

4. The sheet processing device according to claim 1, wherein the pressing unit changes the angle θ for each copy, and the moving unit moves the pressing unit in which the angle θ has been changed.

5. The sheet processing device according to claim 1, wherein the pressing unit changes the angle θ depending on number of times of pressing, and the moving unit moves the pressing unit in which the angle θ has been changed.

6. The sheet processing device according to claim 1, wherein a change pattern of the angle θ is set based on a pattern set in advance.

7. The sheet processing device according to claim 1, wherein the angle θ is changed based on booklet information including one of sheet information, a stitching position, and number of sheets to be stitched.

8. The sheet processing device according to claim 1, wherein the angle θ is set by a user.

9. An image forming system comprising the sheet processing device according to claim 1.

10. The sheet processing device according to claim 1, wherein the rotational center of the second roller is moved by an eccentric cam.

11. The sheet processing device according to claim 1, wherein the rotational center of the second roller is movable between at least a first position aligned with the rotational center of the first roller and a second position downstream of the rotational center of the first roller.

12. The sheet processing device according to claim 1, wherein the rotational center of the second roller is further movable to a third position upstream of the rotational center of the first roller.

13. A method of additionally folding a sheet bundle in a sheet processing device including a pressing unit that presses a fold line part of a folded sheet bundle, and a moving unit that moves a pressing position of the pressing unit in a fold direction of the sheet bundle, the method comprising:

additionally folding a fold line part of the folded sheet bundle with the pressing unit including a pair of pressing rollers that holds the folded sheet bundle therebetween, and changing an angle θ between a thickness direction of the folded sheet bundle and a line connecting rotational centers of the pair of pressing rollers in the additional-folding by fixing the rotational center of a first roller of the pair rollers relative to the moving unit and moving the rotational center of a second roller of the pair of rollers in the fold direction relative to the moving unit.

* * * * *